US011421526B2

(12) United States Patent
Bustos et al.

(10) Patent No.: US 11,421,526 B2
(45) Date of Patent: Aug. 23, 2022

(54) COMPLETION AND PRODUCTION APPARATUS AND METHODS EMPLOYING PRESSURE AND/OR TEMPERATURE TRACERS

(71) Applicant: EOG Resources, Inc., Houston, TX (US)

(72) Inventors: Oscar A. Bustos, San Antonio, TX (US); Shashank Raizada, Highlands Ranch, CO (US); Christopher James, San Antonio, TX (US); Tyler Thomason, Midland, TX (US); Shawn Cox, San Antonio, TX (US); Leonardo Maschio, San Antonio, TX (US); Randy L. Rose, San Antonio, TX (US)

(73) Assignee: EOG Resources, Inc., Houston, TX (US)

( * ) Notice: Subject to any disclaimer, the term of this patent is extended or adjusted under 35 U.S.C. 154(b) by 0 days.

(21) Appl. No.: 17/132,881

(22) Filed: Dec. 23, 2020

(65) Prior Publication Data

US 2021/0115784 A1 Apr. 22, 2021

Related U.S. Application Data

(62) Division of application No. 15/906,406, filed on Feb. 27, 2018, now Pat. No. 10,914,163.

(60) Provisional application No. 62/465,690, filed on Mar. 1, 2017.

(51) Int. Cl.

| | |
|---|---|
| ***E21B 47/06*** | (2012.01) |
| ***E21B 47/01*** | (2012.01) |
| ***E21B 33/12*** | (2006.01) |
| *E21B 43/26* | (2006.01) |

(52) U.S. Cl.

CPC ..... *E21B 47/06* (2013.01); *E21B 33/12* (2013.01); *E21B 47/01* (2013.01); *E21B 43/26* (2013.01)

(58) Field of Classification Search

CPC ..... E21B 47/01

See application file for complete search history.

(56) References Cited

U.S. PATENT DOCUMENTS

| | | | |
|---|---|---|---|
| 6,374,913 | B1 | 4/2002 | Robbins et al. |
| 6,679,332 | B2 | 1/2004 | Vinegar et al. |
| 6,915,686 | B2 | 7/2005 | Baustad |
| 6,915,848 | B2 | 7/2005 | Thomeer et al. |

(Continued)

FOREIGN PATENT DOCUMENTS

| | | | |
|---|---|---|---|
| CN | 202900225 | U | 4/2013 |
| WO | 2014/189766 | A2 | 11/2014 |

*Primary Examiner* — Robert E Fuller

(74) *Attorney, Agent, or Firm* — Conley Rose, P.C.

(57) ABSTRACT

A frac plug includes a body having an outer surface, a first pocket in the outer surface, and a second pocket in the outer surface. In addition, the frac plug includes a first sensor removably disposed in the first pocket. The first sensor is configured to measure and record a plurality of pressures. The frac plug also includes a second sensor removably disposed in the second pocket. The second sensor is configured to measure and record a plurality of pressures. Further, the frac plug includes a first cap releasably coupled to the body and closing the first pocket. Moreover, the frac plug includes a second cap releasably coupled to the body and closing the second pocket. The first cap includes a port and the second cap includes a port.

20 Claims, 17 Drawing Sheets

(56) References Cited

U.S. PATENT DOCUMENTS

| | | | | |
|---|---|---|---|---|
| 6,986,282 | B2 | 1/2006 | Ciglenec et al. | |
| 7,082,993 | B2 | 8/2006 | Ayoub et al. | |
| 7,535,795 | B2 | 5/2009 | Varsamis et al. | |
| 8,286,717 | B2 | 10/2012 | Giroux et al. | |
| 9,097,100 | B2 | 8/2015 | Finke et al. | |
| 9,268,059 | B2 | 2/2016 | Ortiz et al. | |
| 9,297,251 | B2 | 3/2016 | Poitzsch | |
| 2005/0269083 | A1 | 12/2005 | Burris, II et al. | |
| 2010/0155055 | A1 | 6/2010 | Ash et al. | |
| 2013/0020130 | A1 | 1/2013 | Trinh et al. | |
| 2014/0208847 | A1 | 7/2014 | Baranov et al. | |
| 2015/0007977 | A1 | 1/2015 | Lembcke et al. | |
| 2015/0090495 | A1* | 4/2015 | McGinnis ..... | E21B 47/01 175/40 |
| 2018/0245448 | A1 | 8/2018 | Fripp et al. | |

* cited by examiner

COMPLETION AND PRODUCTION APPARATUS AND METHODS EMPLOYING PRESSURE AND/OR TEMPERATURE TRACERS

CROSS-REFERENCE TO RELATED APPLICATIONS

This application is a divisional of U.S. patent application Ser. No. 15/906,406 filed Feb. 27, 2018, which claims benefit of U.S. provisional patent application Ser. No. 62/465,690 filed Mar. 1, 2017, and entitled "Completion and Productions Apparatus and Methods Employing Pressure and/or Temperature Tracers," which are each hereby incorporated herein by reference in their entireties.

STATEMENT REGARDING FEDERALLY SPONSORED RESEARCH OR DEVELOPMENT

Not applicable.

BACKGROUND

The disclosure relates generally to wellbore completion and hydrocarbon production apparatus and methods that employ pressure and/or temperature tracers. More particularly, the disclosure relates to downhole applications that utilize pressure and/or temperature tracers to measure, record, and monitor downhole pressures and/or temperatures during fracing operations and production operations.

To recover hydrocarbons from a reservoir within a subterranean formation, a borehole is drilled into the formation, the borehole is prepared for production, and then the hydrocarbons are produced via the wellbore. During drilling operations a drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path towards a target zone. After drilling the borehole, it is completed in anticipation of production. During completion operations, the borehole is prepared for production by installing the hardware and equipment necessary to enable safe and efficient production of hydrocarbons from the resulting wellbore. A borehole is typically completed by lining the borehole with casing to ensure borehole integrity, perforating the casing to provide fluid communication between the inside of the casing and the surrounding reservoir, and installing production tubulars used to transport produced fluids (e.g., oil and gas) entering the casing to the surface. In some cases, well-stimulation techniques are applied during completion operations to facilitate and/or enhance production from the surrounding reservoir. For example, hydraulic fracturing (also referred to as "fracing") is a well-stimulation technique in which the formation rock containing the reservoir is fractured by a pressurized liquid and proppant placed to enhance fluid communication between the reservoir and the wellbore. After completing the borehole, hydrocarbons from the reservoir are produced by allowing the hydrocarbons to enter the casing through the perforations in the casing, and then transporting the hydrocarbons to the surface via the production tubulars. Natural reservoir pressure and/or artificial lift techniques may be employed to facilitate the production of the hydrocarbons to the surface.

BRIEF SUMMARY OF THE DISCLOSURE

Embodiments of frac plugs for frac plug assemblies are disclosed herein. In one embodiment, a frac plug comprises a body having an outer surface, a first pocket in the outer surface, and a second pocket in the outer surface. In addition, the frac plug comprises a first sensor removably disposed in the first pocket. The first sensor is configured to measure and record a plurality of pressures. Further, the frac plug comprises a second sensor removably disposed in the second pocket. The second sensor is configured to measure and record a plurality of pressures. Still further, the frac plug comprises a first cap releasably coupled to the body and closing the first pocket. Moreover, the frac plug comprises a second cap releasably coupled to the body and closing the second pocket. The first cap includes a port and the second cap includes a port.

Embodiments of methods for completing wellbores are disclosed herein. In one embodiment, a method for completing a wellbore extending through a subterranean formation comprises (a) coupling a frac plug to an isolation block to form a frac plug assembly. In addition, the method comprises (b) lowering the frac plug assembly into the wellbore after (a). Further, the method comprises (c) setting the frac plug assembly in the wellbore to isolate a first zone in the wellbore above the frac plug assembly from a second zone in the wellbore below the frac plug assembly. Still further, the method comprises (d) pumping a pressurized fracing fluid into the first zone to hydraulically fracture the formation after (c). Moreover, the method comprises (e) measuring and recording a plurality of pressures in the first zone during (d) with a first sensor disposed in the frac plug, and measuring and recording a plurality of pressures in the second zone during (d) with a second sensor disposed in the frac plug.

Another embodiment of a method for completing a wellbore extending through a subterranean formation comprises (a) coupling a frac plug to an isolation block to form a frac plug assembly. In addition, the method comprises (b) lowering the frac plug assembly into the wellbore after (a). Further, the method comprises (c) setting the frac plug assembly in the wellbore to isolate a first zone in the wellbore above the frac plug assembly from a second zone in the wellbore below the frac plug assembly. Still further, the method comprises (d) pumping a pressurized fracing fluid into the first zone to hydraulically fracture the formation after (c). Moreover, the method comprises (e) measuring and recording a plurality of temperatures in the first zone during (d) with a first sensor disposed in the frac plug, and measuring and recording a plurality of temperatures in the second zone during (d) with a second sensor disposed in the frac plug.

Embodiments of tools for measuring and recording downhole conditions are disclosed herein. In one embodiment, a tool for measuring and recording downhole conditions during a production operation comprises a tubular sub having a central axis, a first end, a second end opposite the first end, a radially outer surface extending axially from the first end to the second end, a radially inner surface extending axially from the first end to the second end, a first pocket extending radially from the radially outer surface, and a second pocket extending radially from the radially outer surface. The radially inner surface defines a throughbore extending axially from the upper end to the lower end. In addition, the tool comprises a first sensor disposed in the first pocket. Further, the tool comprises a second sensor disposed in the second pocket. Still further, the tool comprises a first cap releasably coupled to the sub and closing the first pocket. The first cap includes a first port extending therethrough. The first port is in fluid communication with the first pocket and the environment outside the sub. Moreover, the tool comprises a second cap releasably coupled to the sub and closing the second pocket. The second cap is configured to prevent fluid communication between the second pocket and the environment outside the sub. The sub includes a second port extending from the throughbore to the second pocket.

Embodiments of methods for determining conditions in a wellbore are disclosed herein. In one embodiment, a method for determining conditions in a wellbore extending through a subterranean formation comprises (a) deploying a plurality of sensor pods in the wellbore. Each sensor pod includes a housing and a plurality of sensors disposed in the housing. In addition, the method comprises (b) measuring and recording a plurality of pressures and a plurality of temperatures with plurality of sensors of each sensor pod. Further, the method comprises (c) dissolving the housings of the pods to release the plurality of sensors from the pods after (b). Still further, the method comprises (d) lifting the sensors to the surface after (c).

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
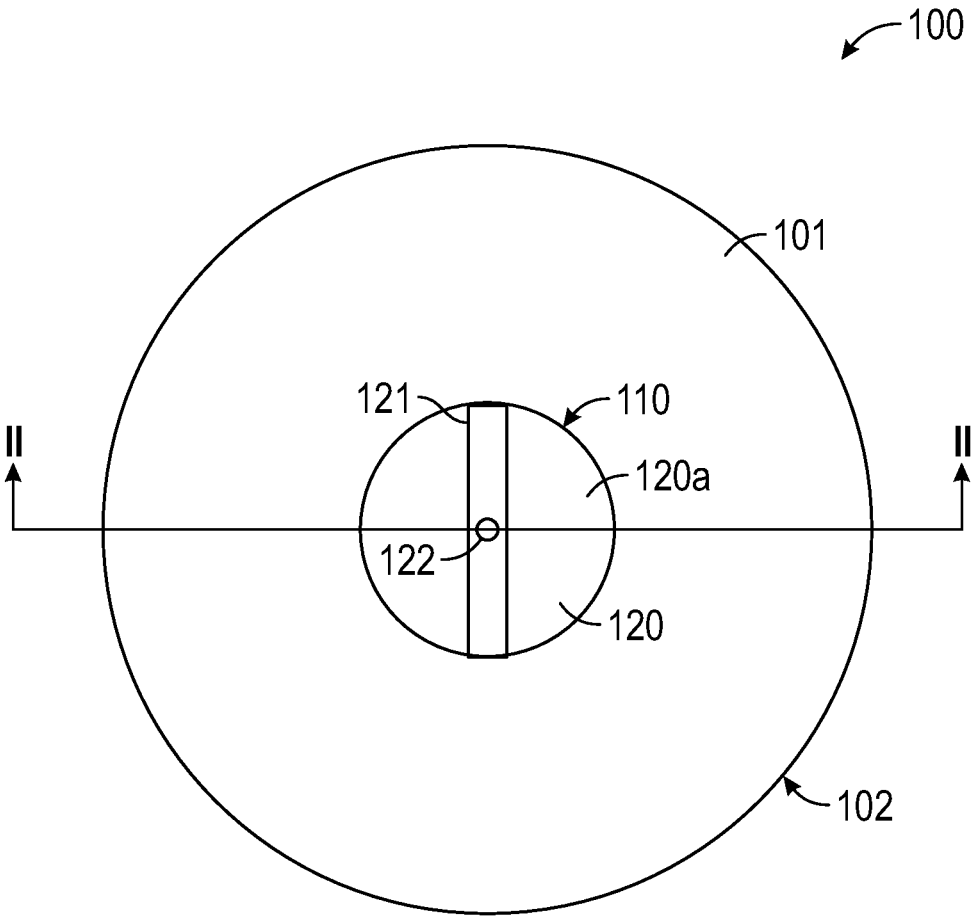
FIG. 1 is a top view of an embodiment of an isolation frac plug in accordance with the principles described herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct engagement between the two devices, or through an indirect connection that is established via other devices, components, nodes, and connections. In addition, as used herein, the terms "axial" and "axially" generally mean along or parallel to a particular axis (e.g., central axis of a body or a port), while the terms "radial" and "radially" generally mean perpendicular to a particular axis. For instance, an axial distance refers to a distance measured along or parallel to the axis, and a radial distance means a distance measured perpendicular to the axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. As used herein, the terms "approximately," "about," "substantially," and the like mean within 10% (i.e., plus or minus 10%) of the recited value. Thus, for example, a recited angle of "about 80 degrees" refers to an angle ranging from 72 degrees to 88 degrees.

During a hydraulic fracing operation, a highly pressurized liquid, referred to as the "frac fluid," is pumped down the wellbore and is utilized to initiate and propagate cracks or fractures in the formation rock extending from perforations in the casing that lines the wellbore. Typically, fracing is performed at a plurality of spaced intervals along the wellbore, each interval defining a frac "stage." At each stage, the casing is perforated and then the portion of the formation extending from the perforations is fraced. Previously fraced stages are isolated from the particular stage being fraced. The cracks formed in the formation by fracing define flow paths through which hydrocarbons in the formation can flow, thereby enhancing fluid communication between the reservoir in the formation and the wellbore.

The pressure and temperature profiles in at the bottom hole during a perforation job provide insight into the effectiveness of the perforation. For example, the size of the pressure spike at the bottom hole assembly (BHA) during a perforation can provide insight into the size and/or geometry of the resulting perforations. As another example, an increase in the temperature of fluids surrounding the BHA shortly after a perforating the casing may indicate an influx of relatively hot formation fluids into the wellbore, which confirms fluid communication between the wellbore and the surrounding formation (i.e., that the perforations extend through the casing).

The pressure profile of the frac fluid within a given stage being fraced (i.e., at the location where the cracks in that stage are initiated) influences the development and behavior of the cracks, and thus, provides insight into the fracing process and formation mechanical properties, which can be used to assess and/or tailor a variety of subsequent activities (e.g., subsequent fracing cycles). In addition, the pressure profile of the fracing fluid during a fracing operation can be used to identify stages that were insufficiently isolated during fracing, which may also influence subsequent operations. For example, if a particular stage was not sufficiently isolated during fracing, it can be fraced again to ensure sufficient initiation and propagation of cracks in the formation surrounding that stage.

When working with downhole pressure and temperature measurements, it is preferable to obtain measurements as close as possible to the perforations, where either fluids are injected during a fracturing stage, or where reservoir fluids (including hydrocarbons) enter the wellbore. Embodiments described herein offer the potential to measure temperatures and pressures proximal the perforations to enable a more clear and accurate understanding of the fluid distribution (injection and/or production), as measurements proximal the perforations will substantially reduce and/or eliminate any fluid friction that is often misunderstood and yields significant uncertainties.

The acquisition of downhole temperature and pressure measurements in accordance with embodiments described herein, in particular the downhole treating pressure during fracturing, which is usually an important input into fracturing simulators, offers the potential to enhance the ability of engineers to use the downhole treating pressure to more accurately estimate number of perforations clusters hydraulically connected to the fracture network, the total amount of additional pressure at the nearwellbore (commonly referred as "nearwellbore" pressure), the type of fracture network or geometry being generated, and optimize the fracturing job treatment by adjusting parameters such as injection rate, sand concentration, fluid viscosity, chemicals added, etc.

The pressure and temperature profiles along a wellbore during production operations can assist with production profiling, as well as aid in the identification and location of loss circulation zones. For example, insight into the pressure and temperature within different stages of the wellbore over time can help the operator identify stages that are producing and stages that are not producing (or are insufficiently producing). In artificial lift production operations, comparison of the pressure profiles in the annulus (between a production string and the casing) and the inside of the production string can be used to determine the efficiency of the lift mechanism, and subsequently, optimize the lift mechanism employed.

For at least the foregoing reasons, the pressure and temperature profiles of fluids in a wellbore during various downhole operations such as drilling, completion, and production operations can provide valuable insight. Embodiments of apparatus and methods described herein provide means for measuring downhole temperatures and pressures during a variety of downhole operations.

Figure 2:
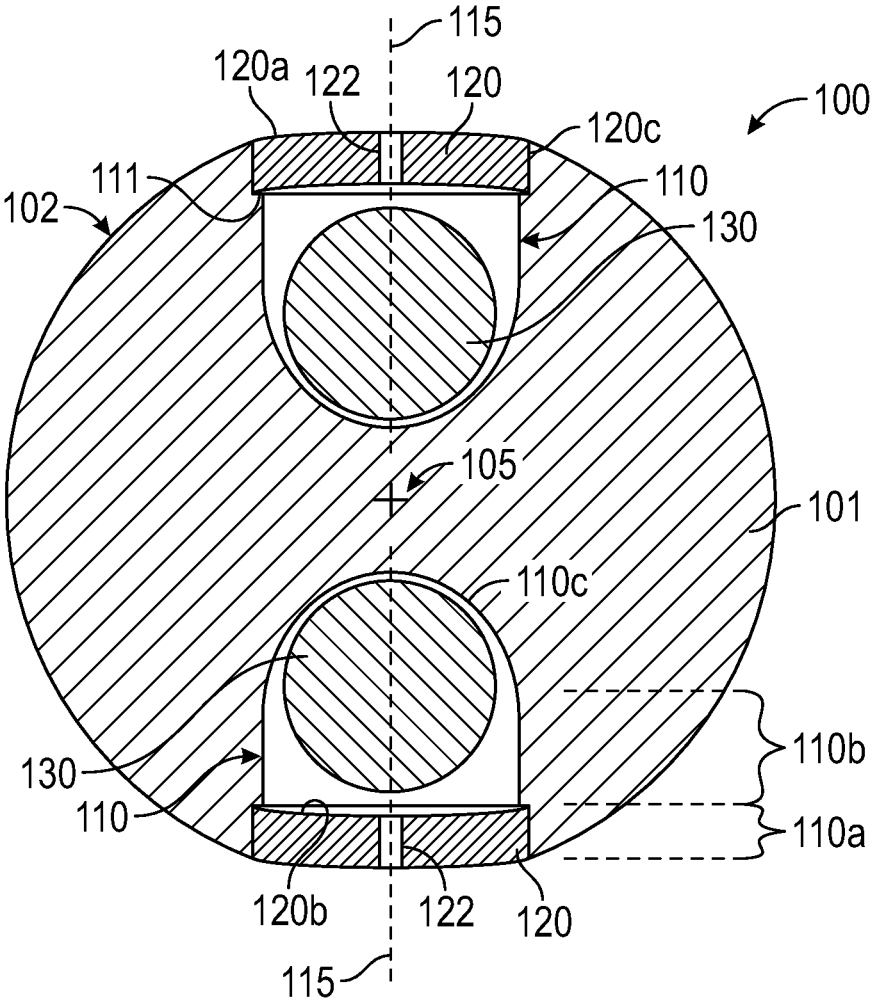
FIG. 2 is a cross-sectional view of the isolation frac plug of FIG. 1 taken along section II-II of FIG. 1.

Referring now to FIGS. 1 and 2, an embodiment of a frac plug 100 for use in completion operations is shown. In this embodiment, frac ball 100 is in the form of a spherical ball, and thus, may also be referred to as a frac "ball." In particular, frac ball 100 includes a body 101 having a spherical outer surface 102, a plurality of recesses or pockets 110 extending from the outer surface 102, a plurality of caps 120 releasably secured to body 101, and a sensor 130 disposed within each pocket 110.

As best shown in FIG. 2, body 101 has a geometric center 105 and each pocket 110 has a central or longitudinal axis 115. A projection of each axis 115 intersects center 105, and thus, recesses 105 may be described as extending radially from outer surface 102 toward center 105. In this embodiment, two diametrically opposed pockets 110 are provided. The pair of pockets 110 are angularly spaced 180° apart and positioned on opposite sides of body 101 with axes 115 coaxially aligned.

Each pocket 110 is identical in this embodiment. In particular, each pocket 110 includes a first or outer cylindrical section 110*a* extending axially (relative to axis 115) from outer surface 102, a second or intermediate cylindrical section 110*b* extending axially (relative to axis 115) from first section 110*a*, and an inner concave semi-spherical section 110*c* extending axially (relative to axis 115) cylindrical section 110*b*. Thus, section 110*b* is axially positioned (relative to axis 115) between sections 110*a*, 110*c*. Section 110*a* has a diameter greater than the diameter of section 110*b*, thereby defining an annular shoulder 111 therebetween. Semi-spherical section 110*c* of each pocket 110 defines its radially inner terminal end proximal center 105. It should be appreciated that pockets 110 do not extend to center 105 and do not intersect each other. Accordingly, pockets 110 are not in fluid communication with each other and may be described as being isolated from each other.

Referring again to FIGS. 1 and 2, caps 120 close pockets 110 and maintain sensors 130 within pockets 110, but allow fluid communication between pockets 110 and the surrounding environment. One cap 120 is provided for each pocket 110. In this embodiment, each cap 120 is a circular disc having a first or outer convex semi-spherical surface 120*a*, a second or inner concave semi-spherical surface 120*b* opposite surface 120*a*, and a cylindrical surface 120*c* extending between surfaces 120*a*, 120*b*. Surfaces 120*a*, 120*b* on each cap 120 are parallel, and further, outer surfaces 120*a* of caps 120 have a radius of curvature that is equal to the radius of body 101. Each cap 120 is releasably secured to body 101 within section 110*a* of the corresponding pocket 110. More specifically, surface 120*c* of each cap 120 includes external threads that engage mating internal threads provided along section 110*a* of the corresponding pocket 110. Caps 120 are threaded into sections 110*a* of pockets 110 until caps 120 are seated against annular shoulders 111. An elongate linear slot 121 is provided in outer surface 120*a* of each cap 120 to assist in threading and unthreading caps 120 into and from pockets 110 in body 101. In addition, each cap 120 includes a throughbore or port 122 that extends therethrough. Each port 122 extends from outer surface 120*a* to inner surface 120*b*, thereby allowing fluid communication between the environment outside frac ball 100 and the corresponding pocket 110. In this embodiment, each port 122 is centered on the corresponding cap 120, however, in other embodiments, the ports (e.g., ports 122) are not centered on the caps (e.g., caps 120).

As best shown in FIG. 2, one sensor 130 is removably disposed in each pocket 110. Sensors 130 and pockets 110 are sized such that sensors 130 are loosely placed in pockets 110 and can move rotationally and translationally relative to body 101 within pockets 110. In this embodiment, each sensor 130 is a pressure and/or temperature sensor that measures the pressure and/or temperature within pockets 110, and records and stores the pressure and/or temperature measurements. Since each pocket 110 is in fluid communication with the environment immediately outside the corresponding cap 120 via port 122, the pressures and/or temperatures measured and recorded by sensors 130 are indicative (i.e., the same or substantially the same) of the pressures and/or temperatures immediately outside the frac plug 100 adjacent the corresponding cap 120.

To enable sensors 130 to measure, record, and store pressures and/or temperatures, each sensor 130 includes a pressure and/or temperature transducer, a rechargeable battery (e.g., rechargeable lithium ion battery), and memory (e.g., non-volatile memory), all of which are electrically coupled together. The pressure and/or temperature transducer measures the pressure and/or temperature in the environment immediately surrounding sensor 130 (i.e., the pressure and/or temperature in the corresponding pocket 110), and then converts the measured pressure and/or temperature to an electrical signal that is communicated to the memory, which records and stores the measured pressure and/or temperature. The battery provides power to the components within sensor 130 such that sensor 130 can function autonomously during deployment. In this embodiment, the pressure and/or temperature data recorded in memory of sensors 130 is downloaded and analyzed at the surface after sensors 130 are retrieved to the surface. However, in other embodiments, the sensors (e.g., sensors 130) are configured to wirelessly communicate (passively or actively) the measured pressure and/or temperature data from a downhole location to the surface directly or via one or more intermediary components.

The transducer, battery, memory, and any circuitry that allows the communication of power and/or electrical signals between the components of each sensor 130 are disposed within and protected by an outer housing. For use in relatively harsh downhole conditions, the outer housing of each sensor 130 is preferably designed to allow the sensor 130 to function at pressures of at least 15 k psi and temperatures of at least 310° F. In addition, for deployment in pockets 110 of frac ball 100, as well as in other structures described in more detail below, sensors 130 preferably have a relatively small size. In this embodiment, the outer housing of each sensor 130 is a spherical ball. In general, the greater the size (e.g., outer diameter) of the sensor 130, the larger the battery and memory, which enables longer life downhole and an increase in the number of pressure and/or temperature measurements that can be recorded. Although each sensor 130 can have any suitable outer diameter depending on the particular downhole application, in embodiments described herein, each sensor 130 has an outer diameter preferably greater than or equal to 7.5 mm (~5/16 in.), and more preferably greater than or equal to 20 mm (~13/16 in.). In this embodiment, the outer diameter of each sensor 130 is 20 mm (~13/16 in.), which enables sufficient memory to recorded and store at least 50,000 pressure measurements and/or at least 100,000 individual temperature measurements. It should also be appreciated that the majority of perforations in casing typically have a maximum dimension (width or height) that is less than 20 mm, and thus, sensors 130 having a diameter of 20 mm (or more) reduce the likelihood of any sensor 130 that inadvertently exits a pocket 110 downhole from passing through a perforation.

In general, each sensor 130 can measure, record, and store pressures and/or temperatures continuously or at any suitable frequency. In embodiments described herein, each sensor 130 preferably measures, records, and stores pressure and/or temperatures at least once every 5 minutes, and more preferably at least once every 1 to 2 seconds. However, it should be appreciated that the frequency at which each sensor 130 measures, records, and stores pressure and/or temperature data is variable and programmable, and thus, is not limited to the preferred ranges described above. Without being limited by this or any particular theory, the greater the frequency at which pressure and/or temperature measurements are made and recorded, the greater the energy (battery) and memory requirements.

In general, each sensor 130 can be any suitable sensor, and preferably satisfies the preferences above. Examples of suitable sensors that can be used for sensors 130 described herein are the pressure and/or temperature tracers developed by Dr. Mengjiao Yu of the University of Tulsa, which are disclosed in Shi et al., "Development and Field Evaluation of a Distributed Microchip Downhole Measurement System," SPE-173435-MS, 2015 and Chen et al., "Development of New Diagnostic Method for Lost Circulation in Directional Wells," Journal of Energy and Power Engineering, 2016, each of which is incorporated herein by reference in its entirety for all purposes.

Referring still to FIG. 2, body 101 and caps 120 are made of rigid, durable material(s) suitable for use in the harsh downhole environment. As will be described in more detail below, in this embodiment, frac ball 100 is used in downhole fracing operations, and thus, body 101 and caps 120 are preferably made of material(s) capable of withstanding downhole conditions during perforating and fracing operations. In this embodiment, body 101 and caps 120 are made of a fiber glass reinforced composite, and more specifically, polyether ether ketone (PEEK).

Frac ball 100 can be used during completion operations to measure and record downhole pressures during such operations, and then retrieved to the surface for subsequent analysis of the measured and recorded downhole pressures. For example, FIGS. 3A-3G are sequential illustrations of frac ball 100 (*i*) being deployed downhole (FIGS. 3A and 3B), (ii) being used to measure and record downhole pressures in a wellbore 200 during a perforating operation (FIGS. 3C-3E), (iii) being used to measure and record downhole pressures in wellbore 200 during a hydraulic fracturing operation (FIGS. 3E and 3F), and (iv) being retrieved to the surface for downloading and analysis of the pressure measurements during the perforating and fracturing operations (FIG. 3G). In FIGS. 3A-3G, the downhole operations are carried out in a wellbore 200 including a borehole 201 drilled in a subterranean formation 202 and casing 203 lining the borehole 201.

Figure 3A:
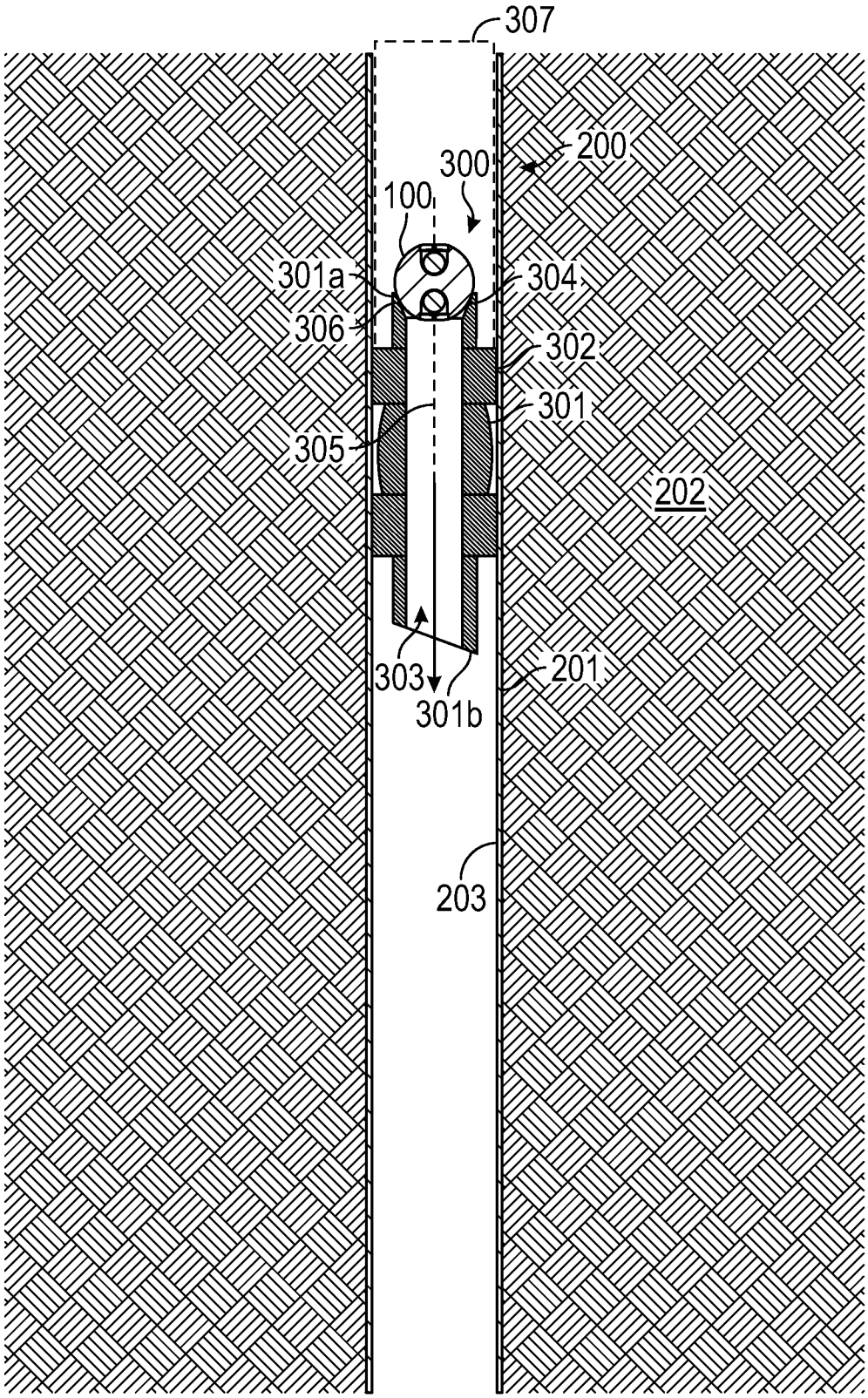
FIGS. 3A-3G are sequential schematic, partial cross-sectional views of a fracing operation in a subterranean wellbore employing the frac plug of FIG. 1.
Figure 3B:
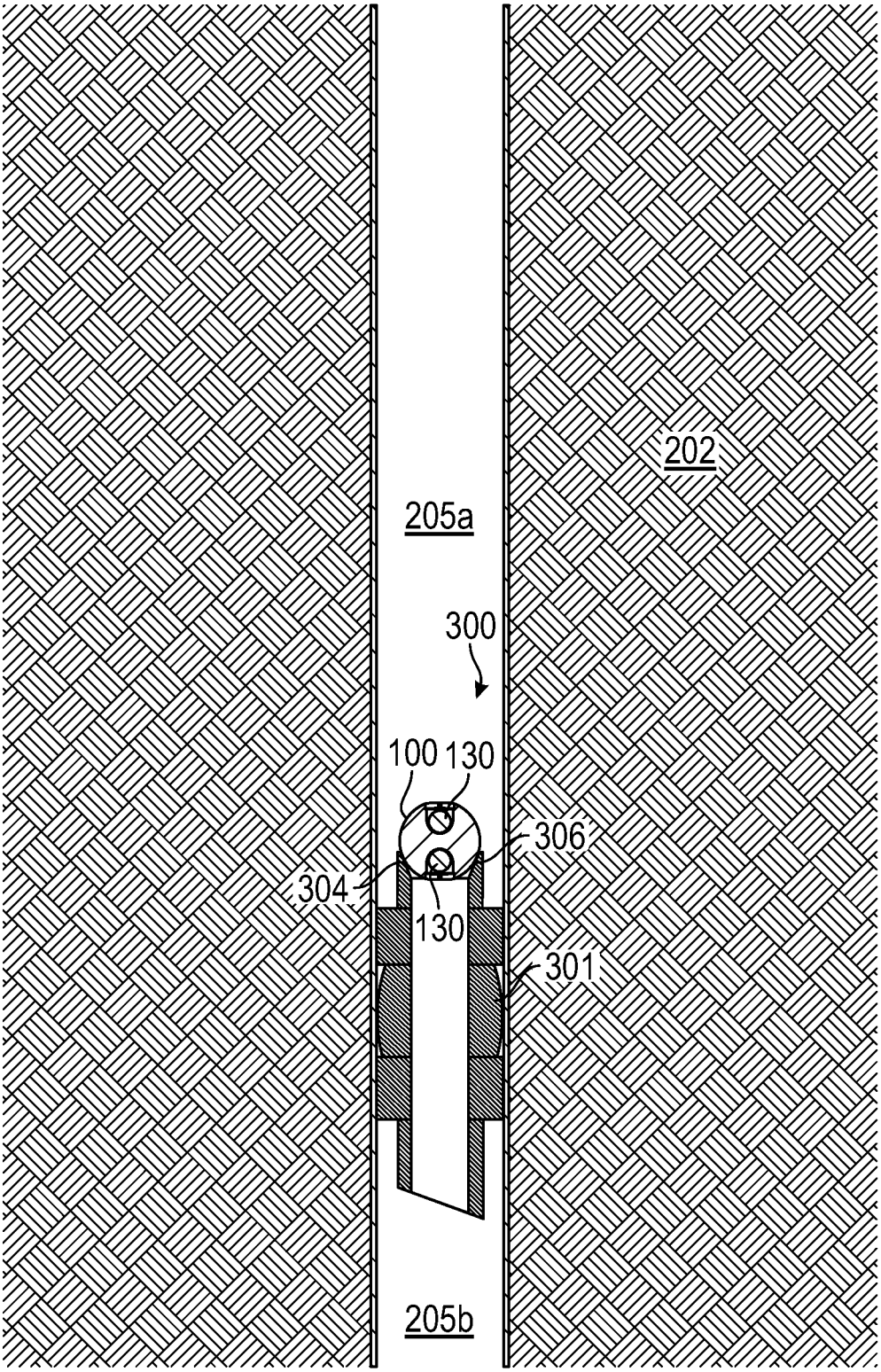

Referring first to FIGS. 3A and 3B, a fracking plug assembly 300 is lowered into wellbore 200 and set at the desired location therein. In this embodiment, fracking plug assembly 300 includes an isolation block 301 and a frac ball 100 removably attached thereto. Isolation block 301 has a central axis 305, an upper end 301*a*, a lower end 301*b*, a radially outer surface 302, and a throughbore 303 extending axially from upper end 301*a* to lower end 301*b*. An annular seat 304 is provided along throughbore 303 at the upper end 301*a*. Frac ball 100 is seated against plug seat 304 and closes off throughbore 303 at upper end 301*a*. In particular, with frac ball 100 sufficiently engaged with and seated against seat 304, an annular seal 306 is formed therebetween; seal 306 prevents fluid flow through throughbore 303.

Moving from FIG. 3A to FIG. 3B, in this embodiment, frac ball 100 is firmly seated against plug seat 304 to form assembly 300 and annular seal 306, and then assembly 300 is lowered into wellbore 200 to the desired location. Wellbore 200 is shut-in during deployment of assembly 300 so that there is no pressure differential across assembly 300. To ensure frac ball 100 remains seated against seat 304 during deployment, frac ball 100 is firmly and removably held against seat 304. In general, frac ball 100 can be firmly and removably held against seat 304 with any suitable means known in the art. In this embodiment, frac ball 100 is firmly and removably held against seat 304 with tape or other degradable adhesive material. As will be described in more detail below, the tape or degradable adhesive material melts or otherwise degrades during subsequent fracing operations, thereby decoupling and releasing frac ball 100 from block 301. One example of a degradable adhesive tape that can be used to releasably secure ball 100 to against seat 304 is degradable flagging tape available from Pesco Products Co. of Sherman, Tex. Isolation block 301 is set at the desired location within wellbore 200, thereby securing assembly 300 at the desired location and forming an annular seal between outer surface 302 of isolation block 301 and casing 203. Thus, with block 301 sealingly engaging casing 203 and ball 100 sealingly engaging seat 304, assembly 300 fluidly isolates a first stage or zone 205*a* of wellbore 200 above assembly 300 from a second stage or zone 205*b* of wellbore 200 below assembly 300. In general, assembly 300 can be lowered downhole using any means known in the art including, without limitation, a wireline, a tubing string, or the like. In addition, isolation block 301 can be any isolation block known in the art and be set in wellbore 200 by any means known in the art. For instance, a variety of commercially available isolation blocks and associated setting tools (e.g., setting tool 307 shown in FIG. 3A) used in completion options for both vertical and horizontal wells can be employed. Such known setting tools 307 often use a small amount of explosive material, that when ignited by using a wireline cable, generates expanding hot gases in a closed chamber. In response to the expanding gases, a movable piston within the closed chamber shears pins holding the isolation block to the setting tool 307 and actuates the slips of isolation block, thereby simultaneously disconnecting the setting tool 307 from the isolation block and setting the isolation block at the desired depth. In this embodiment, assembly 300 is set in a vertical section of wellbore 200. However, in other embodiments, the fracking assembly (e.g., assembly 300) can be set in a section of the wellbore (e.g., wellbore 200) that is horizontal or disposed at an angle between horizontal and vertical.

In this embodiment, frac ball 100 is seated and held against seat 304 in a particular orientation during deployment and subsequent perforating and hydraulic fracturing operations. More specifically, frac ball 100 is oriented with pockets 110 and corresponding caps 120 on opposite sides (e.g., above and below) annular seal 306. As a result, once isolation block 301 is set in wellbore 200, pockets 110 and sensors 130 therein are fluidly isolated from each other with one pocket 110 and corresponding sensor 130 facing the fluid in wellbore 200 above assembly 300, and the other pocket 110 and corresponding sensor 130 facing the fluid in wellbore above assembly 300. This positions and enables one sensor 130 to measure the pressure in first zone 205*a*, and positions and enables the other sensor 130 on the opposite side of frac plug 100 to measure the pressure in second zone 205*b*.

Figure 3C:
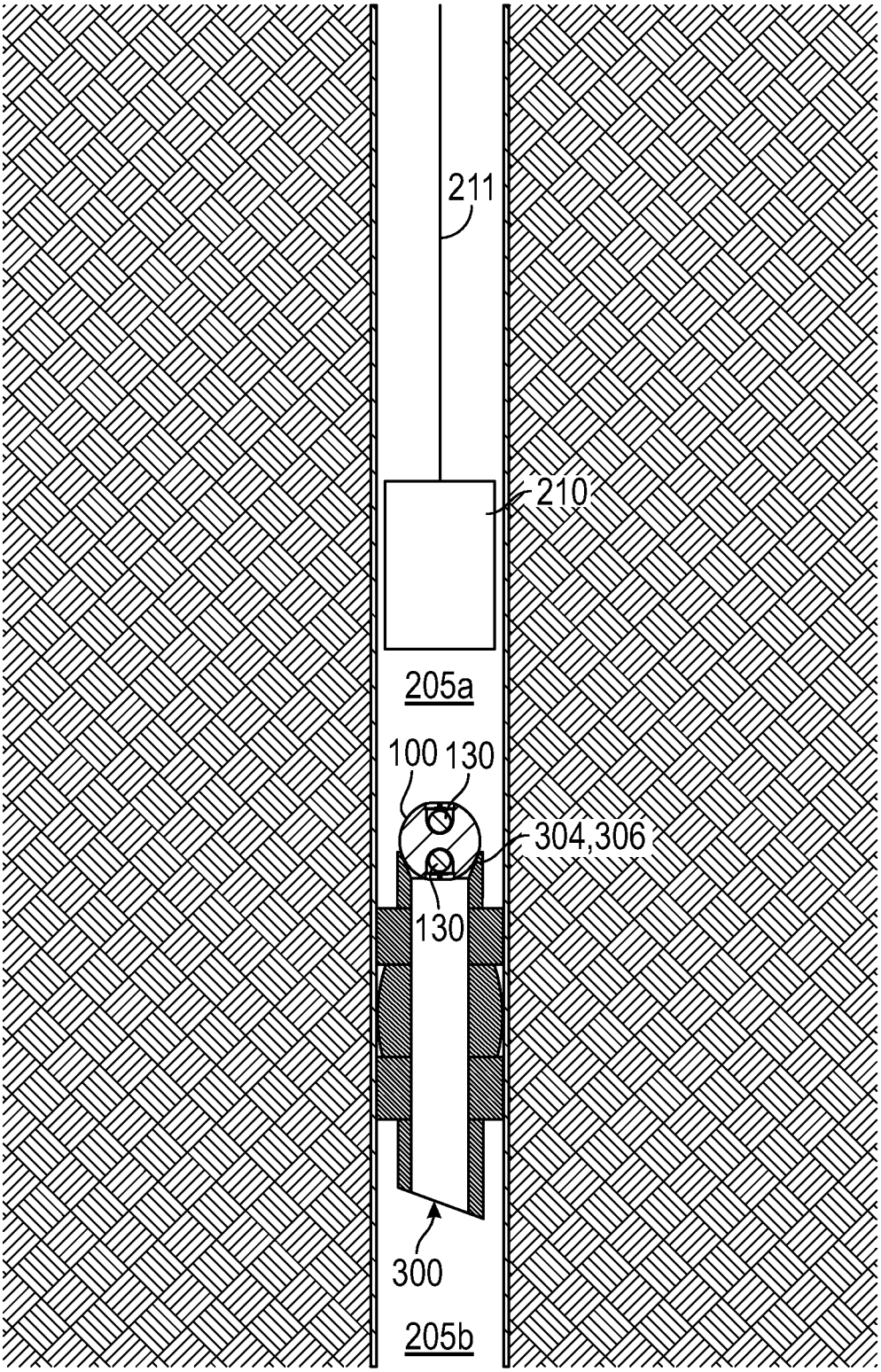
Figure 3D:
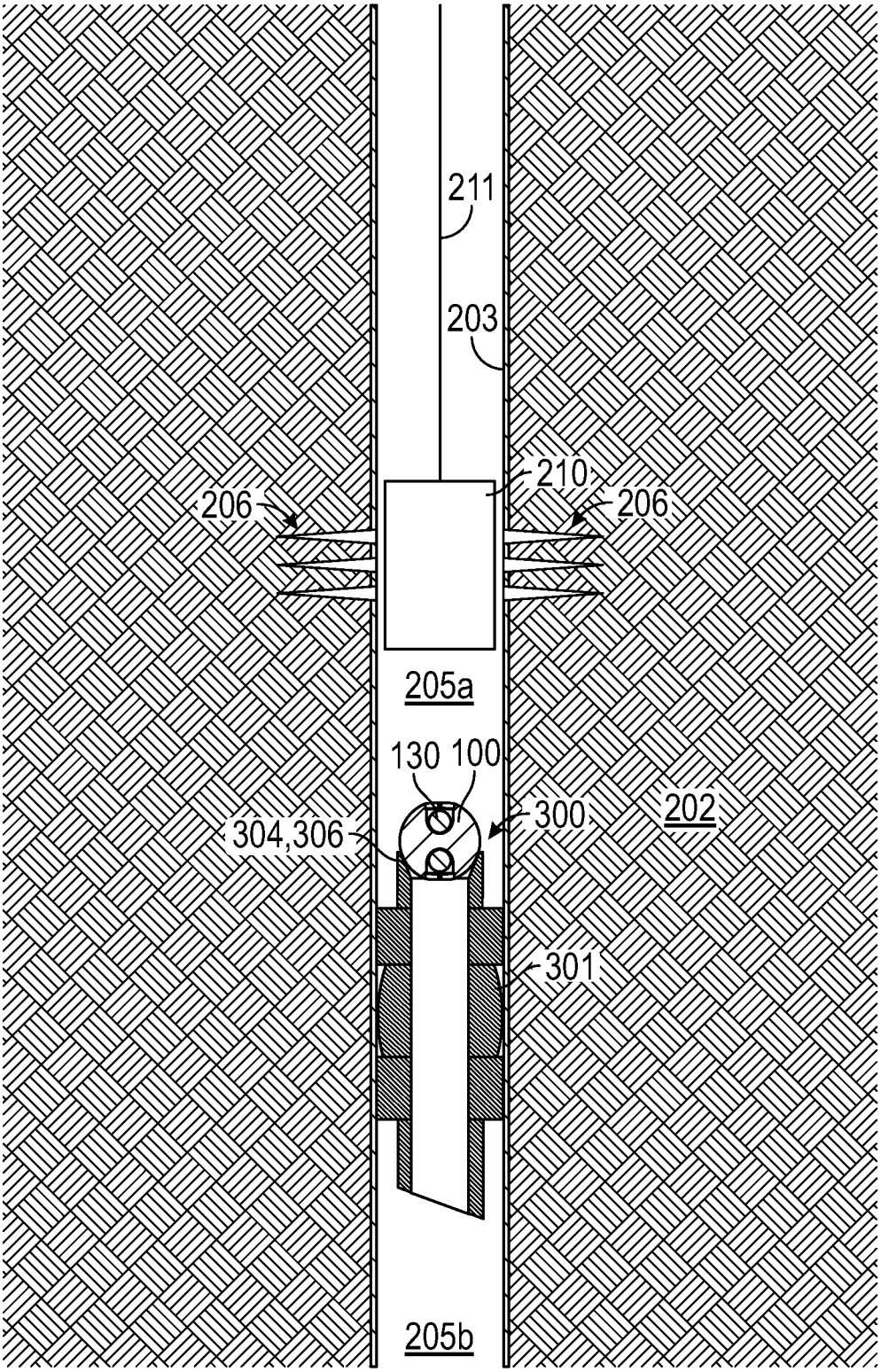
Figure 3E:
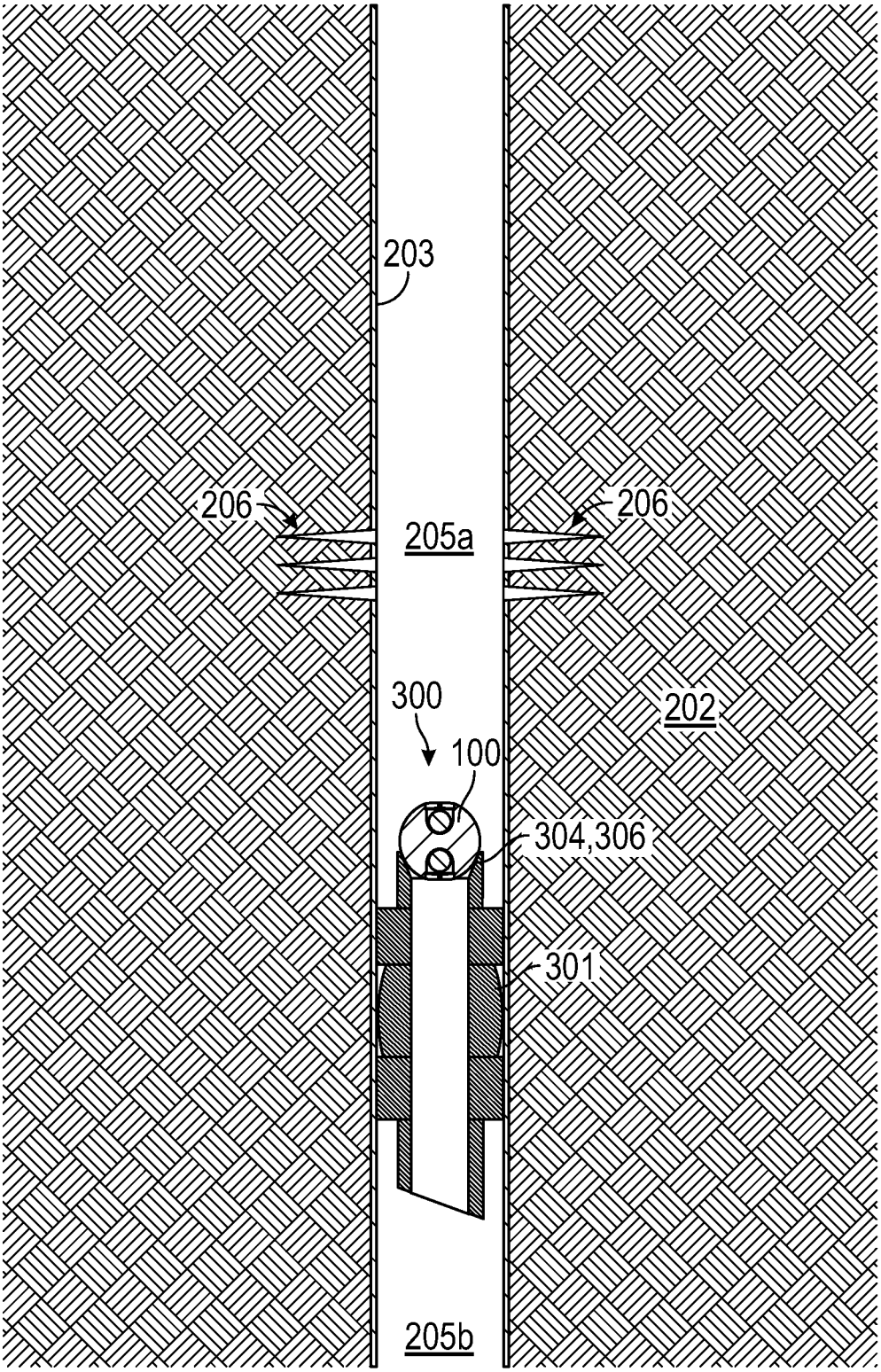

Moving now to FIGS. 3C-3E, a perforation operation is performed to perforate casing 203 and provide fluid communication between wellbore 200 and the surrounding formation 202, thereby allowing hydrocarbons in formation 202 to migrate into wellbore 200. In FIG. 3C, a perforating device or tool 210 is lowered from the surface into wellbore 200 on wireline 211. In particular, tool 210 is lowered to the desired location in first zone 205*a* above assembly 300. Moving now to FIG. 3D, tool 210 is activated to punch a plurality of holes or perforations 206 through casing 203 and into formation 202. In general, tool 210 can be any perforating device known in the art including, without limitation, a perforating gun that includes a plurality of perforating charges that are detonated to punch perforations 206 through casing 203. Following the formation of perforations 206, perforating tool 210 is retrieved to the surface and removed from wellbore 200 as shown in FIG. 3E, which marks the end of the perforating operation. In the embodiment shown in FIGS. 3A-3E, perforating tool 210 is deployed after deployment and setting of isolation block 301. However, in other embodiments, a single downhole assembly including, from bottom to top, an isolation block, an isolation block setting tool (e.g., setting tool 307), a perforating device (e.g., perforation guns), a casing collar locator (for depth control), and a wireline head that connects a wireline cable to the assembly can be deployed downhole in a single trip. Once the assembly is disposed at the desired depth, the setting tool is actuated to set the isolation block, the perforation device is operated to form perforations in the casing, and the setting tool is retrieved to the surface.

As previously described, frac ball 100 is firmly and removably held against seat 304, which helps maintain seal 306 during the perforating operation shown in FIGS. 3C and 3D. In addition, wellbore 200 is shut in during the perforating operation. As a result, the hydrostatic head of fluid in wellbore 200 above assembly 300 (e.g., fluid head in zone 205*a*), the temporary pressure spike in zone 205*a* (relative to zone 205*b*) during activation of tool 210, and the increase in pressure in zone 205*a* (relative to zone 205*b*) due to any influx of fluids from formation 202 into zone 205*a* facilitate the firm engagement of frac ball 100 against seat 304 and maintenance of seal 306 during the perforating operation.

Due to the orientation of sensors 130 previously described, sensors 130 measure and record the fluid pressures in zones 205*a*, 205*b* during the perforating operation. It should be appreciated that the difference in the measured pressures in zones 205*a*, 205*b* at any given time represents the pressure differential across assembly 300.

Figure 3F:
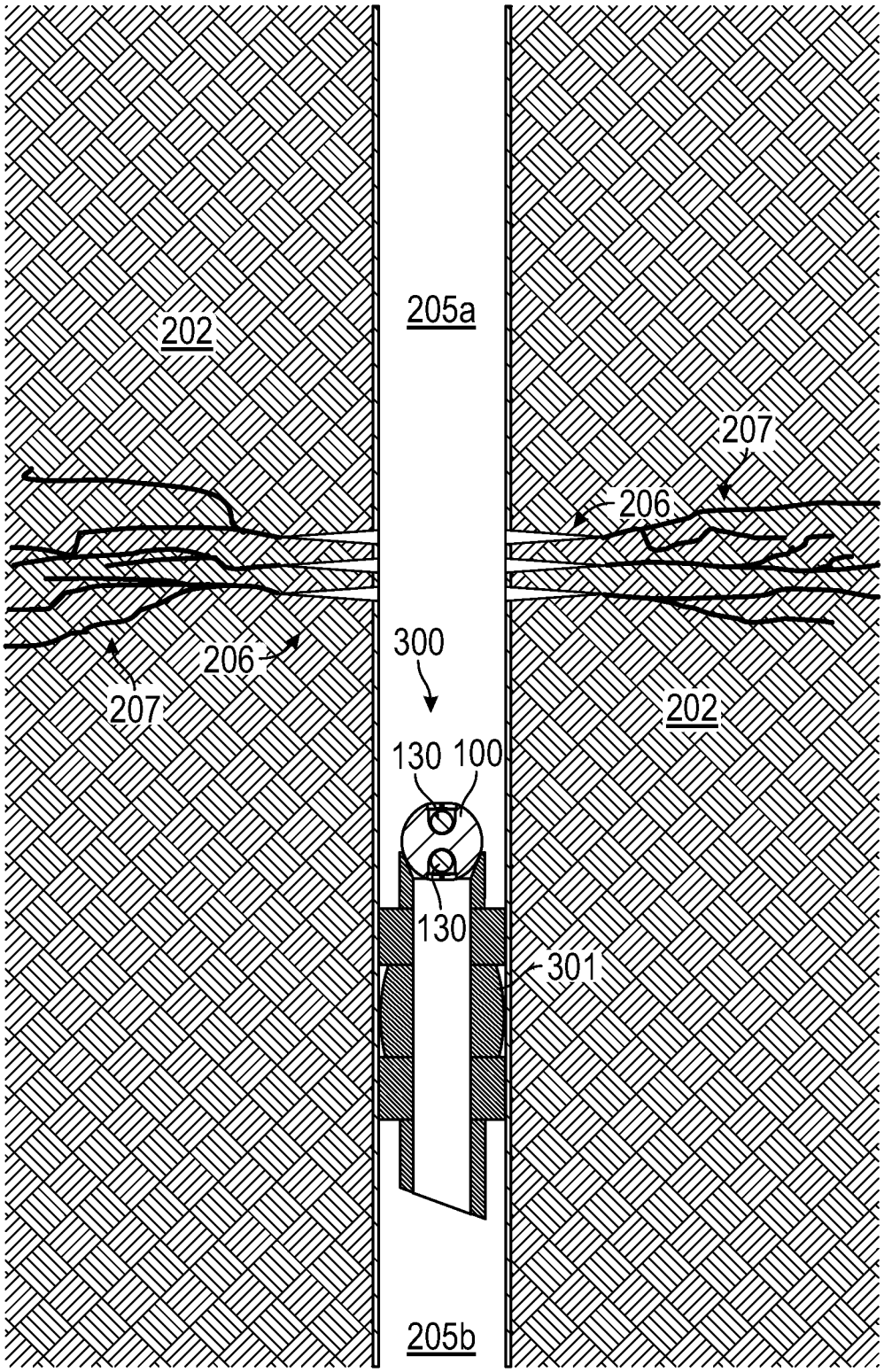
Figure 3G:
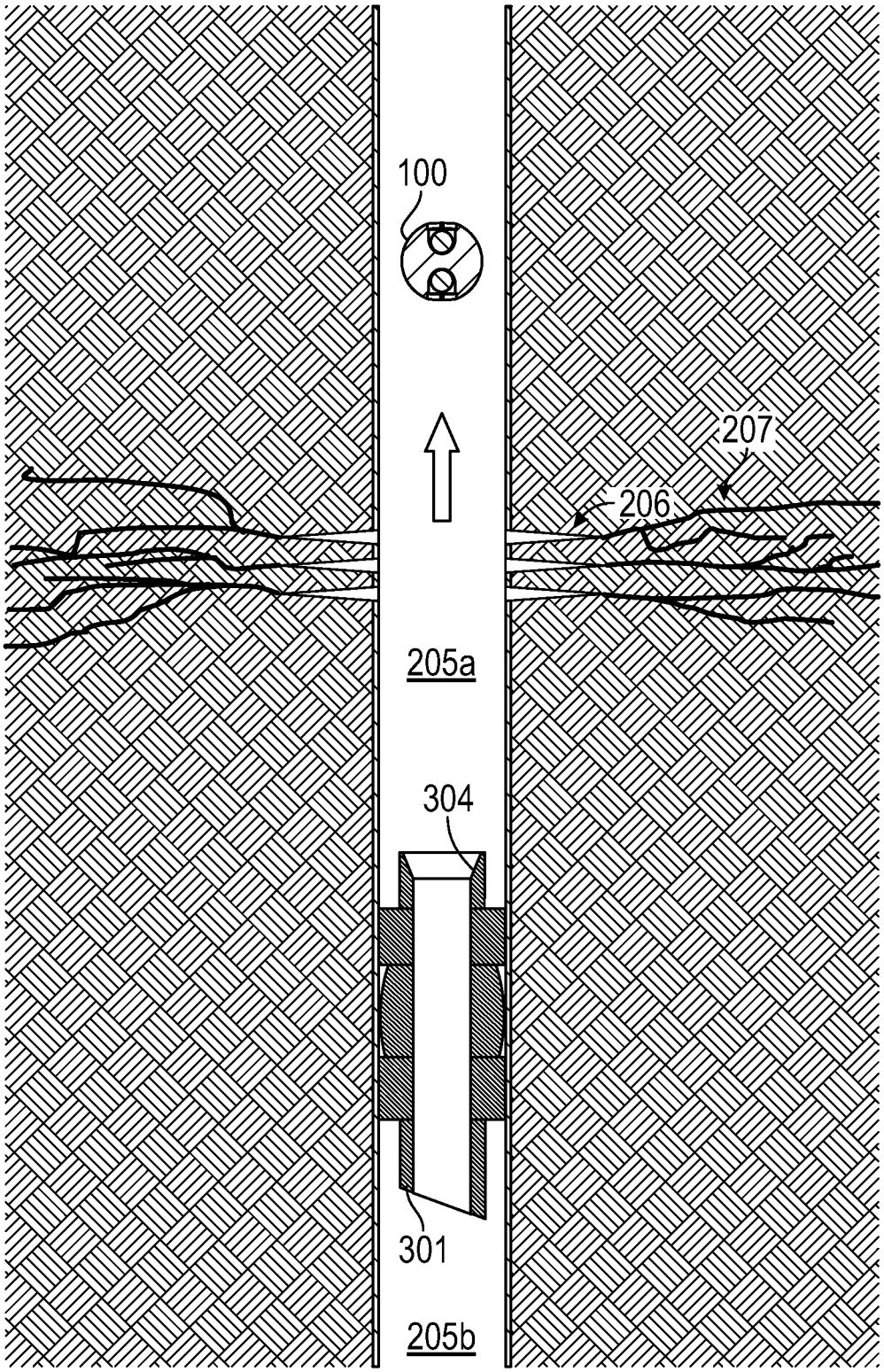

Moving now to FIGS. 3E and 3F, a fracking operation is performed to initiate and propagate fractures in the portion of the formation extending from perforations 206, thereby enhancing fluid communication between formation 202 and wellbore 200, which offers the potential to enhance the flow of hydrocarbons from formation 202 into wellbore 200. In FIG. 3E, hydraulic fracing fluid is pumped under from the surface into wellbore 200, and in particular zone 205*a*. The hydraulic fracing fluid is pumped at a pressure sufficient to initiate and propagate fractures 207 that extend from perforations 206 through formation 202 as shown in FIG. 3F.

As previously described, frac ball 100 is firmly and removably held against seat 304 with tape or any other degradable adhesive material in this embodiment. However, during the fracing operation shown in FIGS. 3E and 3F, the temperature within zone 205*a* increases to a sufficient degree to melt the tape. However, similar to the perforating operation, wellbore 200 is shut in during the fracing operation. As a result, the hydrostatic head of fluid in wellbore 200 above assembly 300 (e.g., fluid head in zone 205*a*), the increase in fluid pressure in zone 205*a* (relative to zone 205*b*) while pumping the pressurized hydraulic fracing fluid into zone 205*a*, and any subsequent increase in pressure in zone 205*a* (relative to zone 205*b*) due to any influx of fluids from formation 202 into zone 205*a* facilitate the maintenance of seal 306 during the fracing operation.

Due to the orientation of sensors 130 previously described, sensors 130 measure and record the fluid pressures in zones 205*a*, 205*b* during the fracing operation shown in FIGS. 3E and 3F. It should be appreciated that the difference in the measured pressures in zones 205*a*, 205*b* at any given time represents the pressure differential across assembly 300.

Referring now to FIG. 3G, once the fracing operation is complete, wellbore 200 is opened at the surface to allow the flow of production fluids from wellbore 200 to the surface. As previously described, during the fracing operation, the tape or other degradable adhesive material holding frac ball 100 to isolation block 301 is melted. Thus, once wellbore 200 is opened and fluids begin to flow from wellbore 200, and in particular zone 205*a*, to the surface, frac plug 100 is free to disengage seat 304 and flow to the surface with the fluids. In this manner, frac ball 100 and sensors 130 disposed therein is retrieved to the surface. At the surface, caps 120 are removed from body 101 (unthreaded), sensors pulled from pockets 110, and the pressure measurements recorded and stored in sensors 130 during the perforating operation and the fracing operation are downloaded and analyzed.

In the manner described, frac ball 100 and sensors 130 removably disposed therein can be used to measure, record, and store fluid pressures in zones 205*a*, 205*b* during a perforating operation and subsequent hydraulic fracing operation. As previously described, analysis of the measured pressure profiles at the surface can be used to provide valuable insight as to the effectiveness of the perforation and the fracing process. For example, the pressure profile in zone 205*a* proximal the perforating tool 210 during the formation of perforations 206 can be used to estimate and assess the size and geometry of the resulting perforations 206. As another example, the pressure profile in zone 205*a* proximal perforations 206 during the fracing operation (i.e., the pressure profile of the hydraulic fracing fluid at perforations 206) can be used to assess the initiation and propagation of fractures 207 in formation 202, which in turn, can be used to tailor subsequent fracking cycles. It should also be appreciated that an understanding of bottom hole pressures during a hydraulic fracing operation will allow completions engineer to more accurately match modeled downhole responses with actual measured downhole responses to better assess the type of fracture network of geometry generated. Pressure measurements proximal the perforations can also be used to calibrate fluid friction down the tubulars, which is often a challenging task. Yet one more potential advantage of having pressure measurements immediately uphole and downhole of the isolation block is that it may enable engineers to understand the efficiency of the frac plug itself, as one of the main objectives of the plug is to hydraulically isolated sections of the wellbore that are hydraulically fractured at different times.

In the perforating and fracing operations described above, two sensors 130 are disposed in frac ball 100, and both sensors 130 measure, record, and store downhole pressure data. However, in other embodiments, more than two sensors (e.g., sensors 130) are disposed in the frac plug (e.g., frac plug 100), and further, one or more of the sensors are temperature sensors that measure, record, and store downhole temperature data. In some embodiments, the sensors disposed in the frac ball include a combination of pressure and temperature sensors.

Figure 4:
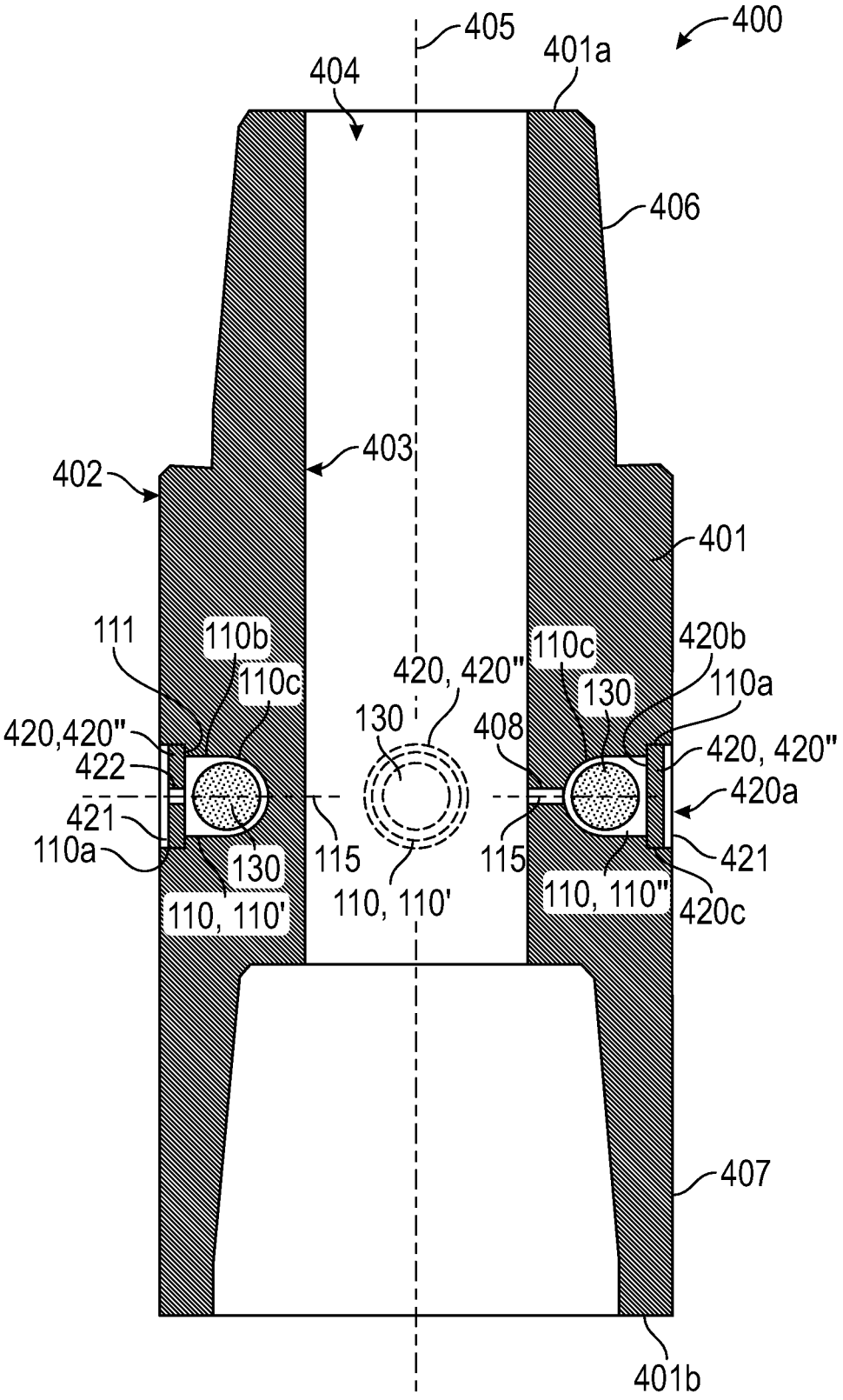
FIG. 4 is a cross-sectional view of a sensor sub in accordance with principles described herein.

Referring now to FIG. 4, an embodiment of a tool 400 for measuring, recording, and storing downhole pressures and/or temperatures during production or drilling operations is shown. In this embodiment, tool 400 is a sub including a tubular body 401 and a plurality of sensors 130 removably disposed in body 401. In particular, body 401 has a central axis 405, a first or upper end 401*a*, a second or lower end 401*b* opposite end 401*a*, a radially outer surface 402 extending axially from upper end 401*a* to lower end 401*b*, and a radially inner surface 403 extending axially from upper end 401*a* to lower end 401*b*. Inner surface 403 defines a throughbore 404 extending axially through body 401. In this embodiment, upper end 401*a* comprises an externally threaded pin end 406, and lower end 401*b* comprises an internally threaded box end 407. Accordingly, tool 400 can be threadably connected to other components in a downhole assembly (e.g., bottomhole assembly) or string (e.g., coiled tubing, tubing, or drillstring). Surfaces 402, 403 are generally cylindrical between pin and box ends 406, 407. A plurality of circumferentially-spaced recesses or pockets 110 are provided in outer surface 402. One sensor 130 is disposed in each pocket 110, and a plurality of caps 420 are releasably secured to body 401 to close off pockets 110 and maintain sensors 130 therein. Each pocket 110 and each sensor 130 is as previously described. In this embodiment, three pockets 110 are provided, with one sensor 130 disposed in each pocket 110. However, in other embodiments, fewer or more pockets (e.g., pockets 110) and corresponding sensors (e.g., sensors 130) are provided.

In this embodiment, a projection of the central axis 115 of each pocket 110 intersects central axis 405 of body 401 and is oriented perpendicular to central axis 405. Accordingly, pockets 110 may be described as extending radially from outer surface 402 toward axis 405. In this embodiment, three pockets 110 are angularly spaced 90° apart. Thus, two of the pockets 110 are diametrically opposed and positioned on opposite sides of body 401 with axes 115 coaxially aligned. Moreover, in this embodiment, pockets 110 are disposed at the same axial distance from each end 401*a*, 401*b*, and thus, axes 115 lie in a plane oriented perpendicular to central axis 405.

It should be appreciated that pockets 110 do not extend to throughbore 404 and do not intersect throughbore 404 or each other. Accordingly, pockets 110 are not in fluid communication with each other and may be described as being isolated from each other.

Referring still to FIG. 4, caps 420 close pockets 110 and maintain sensors 130 within pockets 110. In this embodiment, each cap 420 is a circular disc having a first or outer convex semi-cylindrical surface 420*a*, a second or inner concave semi-spherical surface 420*b* opposite surface 420*a*, and a cylindrical surface 420*c* extending between surfaces 420*a*, 420*b*. Outer surface 420*a* of each cap 420 has a radius of curvature that is equal to the radius of surface 402. Each cap 420 is releasably secured to body 401 within section 110*a* of the corresponding pocket 110. More specifically, surface 420*c* of each cap 420 includes external threads that engage mating internal threads provided along section 110*a* of the corresponding pocket 110. Caps 420 are threaded into sections 110*a* of pockets 110 until caps 420 are seated against annular shoulders 111. An elongate linear slot 421 is provided in outer surface 420*a* of each cap 420 to assist in threading and unthreading caps 420 into and from pockets 110 in body 401.

In this embodiment, two pockets 110, labeled 110' in FIG. 4, are in fluid communication with the environment outside body 401, while the other pocket 110, labeled 110" in FIG. 4, is in fluid communication with throughbore 404. More specifically, two caps 420, labeled "420" in FIG. 4, include throughbores or ports 422 that extends therethrough. Namely, each port 422 extends from outer surface 420*a* to inner surface 420*b* of the cap 420", thereby allowing fluid communication between the corresponding pocket 110' and the environment outside body 401. In this embodiment, port 422 is centered on the corresponding cap 420'. The other cap 420, labeled "420"" in FIG. 4, does not include any port or passage therethrough, and thus, prevents fluid communication between the corresponding pocket 110" and the environment outside body 401. However, body 401 includes a passage or port 408 that extends from inner surface 403 to inner concave semi-spherical section 110*c* of pocket 110". Port 408 allows fluid communication between pocket 110" and throughbore 404.

Referring still to FIG. 4, one sensor 130 is removably disposed in each pocket 110. Sensors 130 and pockets 110 are sized such that sensors 130 are loosely placed in pockets 110 and can move rotationally and translationally relative to body 401 within pockets 110. In general, each sensor 130 can be a pressure and/or temperature sensor that measures the pressure and/or temperature within pockets 110, and records and stores the pressure and/or temperature measurements. Since pockets 110' are in fluid communication with the environment immediately outside body 401 via ports 422 in caps 420', the pressures and/or temperatures measured and recorded by sensors 130 in pocket 110' are indicative (i.e., the same or substantially the same) of the pressures and/or temperatures immediately outside body 401 adjacent caps 420'; and since pocket 110" is in fluid communication with the environment inside body 401 (in throughbore 404) via port 408, the pressures and/or temperatures measured and recorded by sensor 130 in pocket 420" are indicative (i.e., the same or substantially the same) of the pressures and/or temperatures immediately inside body 401 adjacent port 408.

Although each sensor 130 can be a pressure and/or temperature sensor, in the embodiment shown in FIG. 4, one sensor 130 disposed in one pocket 110' is a pressure sensor, one sensor 130 disposed in the other pocket 110' is a temperature sensor, and the sensor 130 disposed in pocket 110" is a pressure sensor. Accordingly, sensors 130 in pockets 110' measure and record the pressures and temperatures immediately outside body 401 adjacent the corresponding caps 420', whereas sensor 130 in pocket 110" measures and records the pressures inside body 401 (i.e., within throughbore 404) adjacent the corresponding port 408.

Referring still to FIG. 4, body 401 and caps 420 are made of rigid, durable material(s) suitable for use in the harsh downhole environment. As will be described in more detail below, in this embodiment, sub 400 is used in downhole production operations, and thus, body 101 and caps 120 are preferably made of material(s) capable of withstanding downhole conditions during production operations. In this embodiment, body 401 and caps 420 are made of steel, and more specifically, stainless steel.

In general, one or more subs 400 can be deployed downhole and used in any downhole operation to measure, record, and store pressure and temperatures over a period of time. For examples, subs 400 can be used in drilling operations (e.g., disposed along a drillstring or in a bottomhole assembly), perforating operations (e.g., deployed on wireline with a perforating assembly or gun), production operations (e.g., disposed along casing or a production string), etc.

Figure 5:
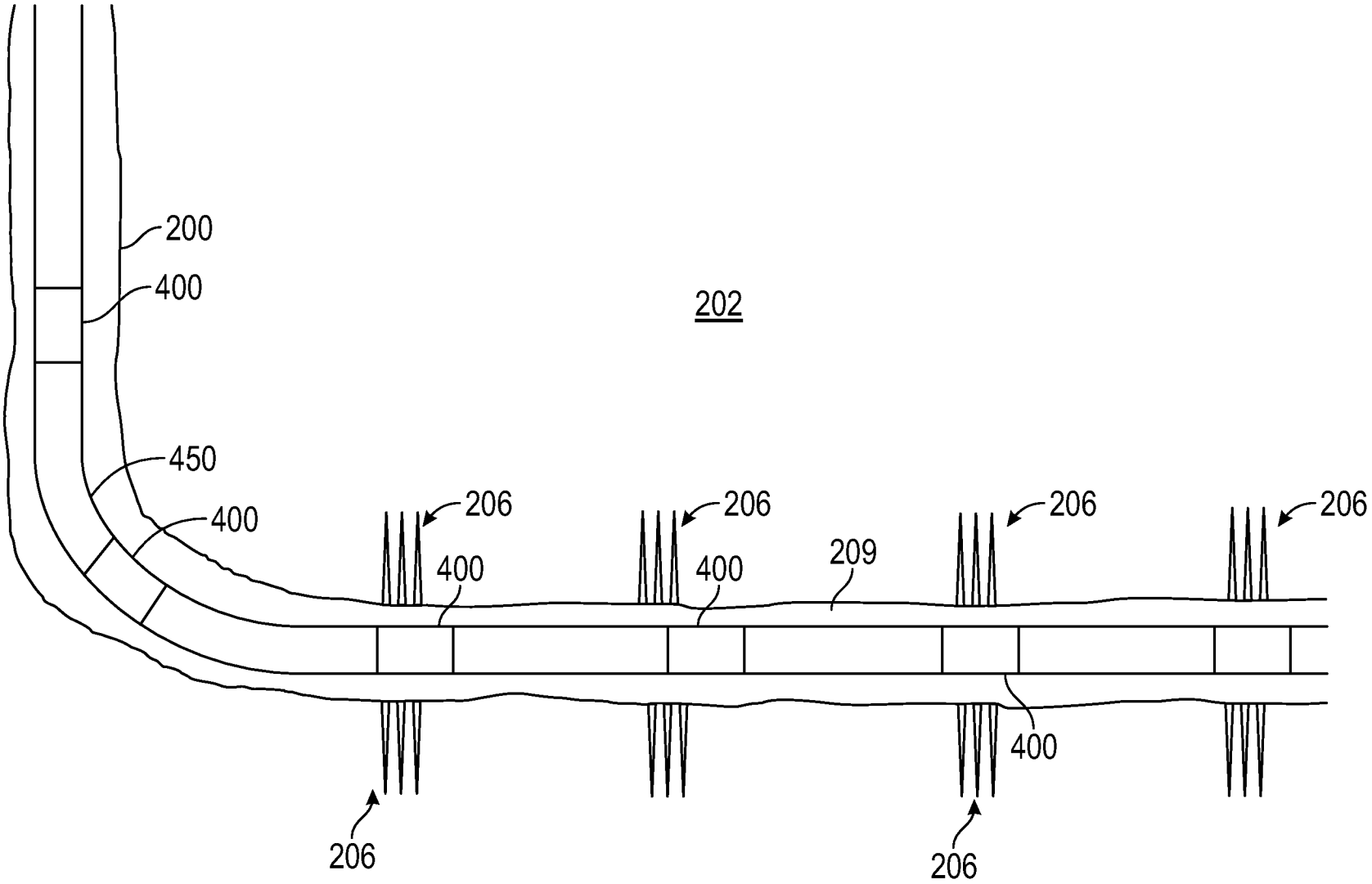
FIG. 5 is a schematic, partial cross-sectional view of a production operation in a subterranean wellbore employing the sensor sub of FIG. 4.

Referring now to FIG. 5, in one exemplary embodiment, a plurality of subs 400 are deployed downhole as part of an elongate tubular production string 450 extending through a wellbore 200 to measure and record downhole pressures and temperatures during production operations. As previously described, wellbore 200 includes a borehole 201 drilled in a subterranean formation 202 and casing 203 lining the borehole 201. Following completion of wellbore 200, a plurality of spaced production stages are provided along wellbore 200, each stage includes perforations 206 that allow the flow of hydrocarbons from formation 202 through casing 203 and into wellbore 200 for subsequent production to the surface through string 450.

In this embodiment, production string 450 is a string of individual tubular joints (e.g., pipe joints) coupled together end-to-end, however, in other embodiments, the production string (e.g., string 450) comprises coiled tubing. Subs 400 are spaced along string 450 to measure, record, and store: (i) pressures in an annulus 209 between string 450 and casing 203 (via pressure sensors 130 in pockets 110'), (ii) temperatures in annulus 209 (via temperature sensors 130 in pockets 110'), and (ii) pressures in the throughbore 404 (via pressure sensors 130 in pockets 110"). When string 450 is pulled to the surface, sensors 130 are removed from pockets 110, and the pressure and temperature measurements recorded and stored in sensors 130 during the production operation are downloaded and analyzed. Due to the distribution of subs 400 along string 450 and the ability of sensors 130 to measure pressures and temperatures in the annulus 209, as well as measure pressures in throughbore 404, the data from sensors 130 can be used to determine the pressure profile along annulus 209 and along throughbore 404 during production, and the temperature profile along annulus 209 during production.

As previously described, the pressure and temperature profiles along a wellbore can provide valuable insight as to the production of the wellbore. For example, such information can aid in the identification and location of loss circulation zones, thief zones, and sink zones where fluids keep recirculating and thereby reduce the cross-sectional area available for fluid flow. In addition, the pressure and temperature profiles along the wellbore can also aid in the identification of stages that are producing and stages that are not producing (or are insufficiently producing) along with the type of fluid entry. Further, in artificial lift production operations, comparison of the pressure profiles in the annulus and the inside of the production string can be used to (i) determine the efficiency of the lift mechanism, and subsequently, optimize the lift mechanism employed, and potentially predict problems associated with artificial lift including failures. In drilling operations, one important parameter for downhole tools like motors and bits is the pressure drop across the tool. Thus, the pressure and temperature profiles along a wellbore offer the potential to quantify such pressure drops, thereby enabling engineers to further optimize the geometry to flowing areas to achieve optimal tool/bit performance. Yet another advantage of having the pressure and temperature profiles along a lateral wellbore is to understand the impact of offset hydraulic fracture stimulations, for instance when horizontal wellbores are drill parallel to each other and one wellbore is completed first, having the second one instrumented with the pods to understand depth at which hydraulic fracture communicates between wellbores.

Figure 6:
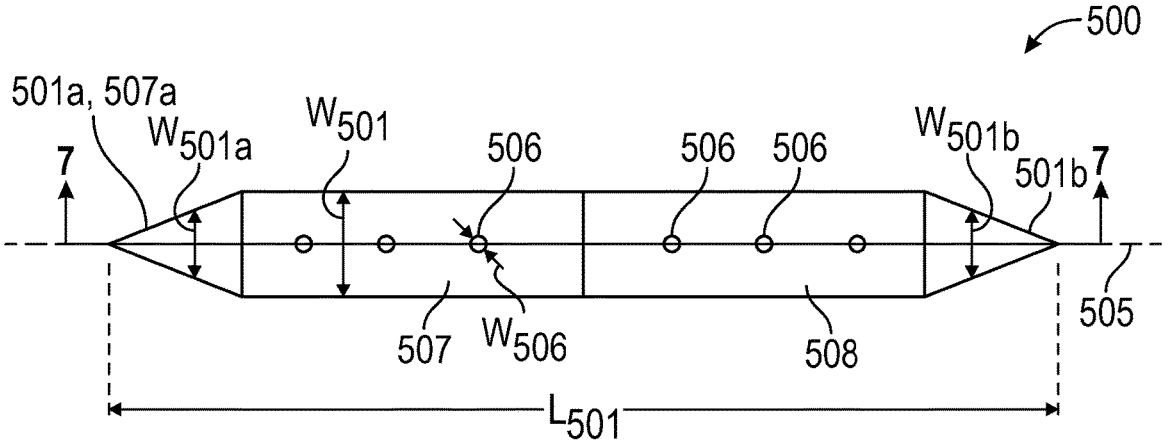
FIG. 6 is a top view of an embodiment of a sensor pod assembly in accordance with the principles described herein.
Figure 7:
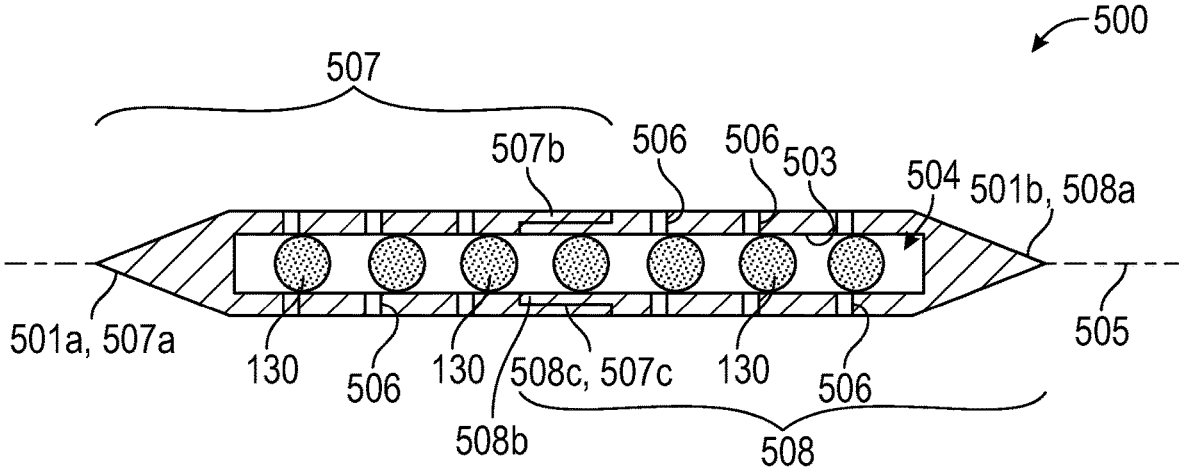
FIG. 7 is a cross-sectional view of the sensor pod assembly of FIG. 6 taken along section 7-7 of FIG. 6.

Referring now to FIGS. 6 and 7, an embodiment of a sensor capsule or pod 500 for measuring, recording, and storing downhole pressures and temperatures during production operations is shown. In this embodiment, pod 500 includes an elongate housing 501 and a plurality of sensors 130 removably disposed in housing 501. In particular, housing 501 has a central or longitudinal axis 505, a first end 501*a*, a second end 501*b* opposite first end 501*a*, a radially outer cylindrical surface 502 extending axially between ends 501*a*, 501*b*, a radially inner cylindrical surface 503 defining an inner cavity or pocket 504, and a plurality of axially spaced holes or ports 506 extending radially from outer surface 502 to pocket 504. In this embodiment, two rows of axially spaced ports 506 are provided in housing 501, with the two rows being spaced 180° apart about axis 505 (i.e., on opposite sides of housing 501). In this embodiment, housing 501 is made of two parts releasably secured to each other. In particular, housing 501 includes a first body section 507 coupled to a second body section 508. First body section 507 has a first end 507*a* defining end 501*a* of housing 501 and a second end 507*b* adjacent second body section 508. Second body section 508 has a first or closed end 508*a* defining end 501*b* of housing 501 and a second or open end 508*b* adjacent first body section 507. In this embodiment, end 507*b* comprises an internally threaded receptacle 507*c* and end 508*b* comprises an externally threaded pin 508*c* threaded into mating receptacle 507*c*, thereby coupling sections 507, 508 to form housing 501. A plurality of the ports 506 are provided in each body section 507, 508.

As will be described in more detail below, pod 500 is designed to be deployed in a wellbore and remain positioned downhole in the presence of the flow of production fluids to the surface. To reduce the likelihood of pod 500 being carried to the surface with the production fluids, pod 500 is preferably oriented substantially parallel to the flow of production fluids and has a hydrodynamic geometry that presents a relatively small projected area to the flow of production fluids. In particular, as best shown in FIG. 6, housing 501 has an outer diameter or width $W_{501}$ measured perpendicular to axis 505 and a length $L_{501}$ measured axially between ends 501*a*, 501*b*. Length $L_{501}$ is substantially greater than width $W_{501}$. In embodiments described herein, the ratio of length $L_{501}$ to width $W_{501}$ is preferably greater than 6.0 and more preferably greater than 8.0. In addition, ends 501*a*, 501*a* of housing 501 have an outer diameter or width $W_{501a}$, $W_{501b}$, respectively, measured perpendicular to axis 505 that decreases moving axially away from pocket 504. In this embodiment, both ends 501*a*, 501*b* are conical, however, in other embodiments, the ends (e.g., ends 501*a*, 501*b*) can have other geometries with a width that decreases moving toward a terminal end (e.g., away from pocket 504).

Pocket 504 is sized to receive and hold sensors 130. In particular, pocket 504 is an elongate cylindrical bore having a diameter $D_{504}$ defined by inner surface 503. The diameter $D_{504}$ of pocket 504 is preferably equal to or greater than the outer diameter of each sensor 130 and less than twice the diameter of each sensor 130. This geometry allows sensors 130 to be advanced into pocket one at a time, while preventing sensors 130 from moving past one another within pocket 504. In the embodiment shown in FIGS. 6 and 7, diameter $D_{504}$ is about the same or slightly greater than (<5% greater than) the diameter of sensors 130. To assembly pod 500, sensors are axially advanced into the portion of pocket 504 in one or both body section(s) 507, 508 via the open end(s) 507*b*, 508*b*, respectively, and once sensors 130 are disposed in body section(s) 507, 508, end 508*b* is threaded into end 507*b*, thereby closing off pocket 504 and securing body sections 507, 508 together to maintain sensors 130 within housing 501.

Ports 506 provides fluid communication between the environment outside housing 501 and pocket 504, thereby enabling sensors 130 to measure pressures and/or temperatures outside housing 501 proximal ports 506. In this embodiment, each port 506 has a diameter or maximum width $W_{506}$ that is less than the diameter of each sensor 130 to ensure that no sensor 130 can exit pocket 504 through a port 506.

Sensors 130 are each as previously described. In general, each sensor 130 can be a pressure and/or temperature sensor that measures the pressure and/or temperature within pocket 504, and records and stores the pressure and/or temperature measurements. Since pocket 504 is in fluid communication with the environment immediately outside body 507 via ports 506, the pressures and/or temperatures measured and recorded by sensors 130 in pocket 504 are indicative (i.e., the same or substantially the same) of the pressures and/or temperatures immediately outside body 507 adjacent ports 506.

Although each sensor 130 can be a pressure and/or temperature sensor, in the embodiment shown in FIGS. 6 and 7, a first plurality of sensors 130 disposed in pocket 504 are pressure sensors and a second plurality of sensors 130 disposed in pocket 504 are temperature sensors. Accordingly, sensors 130 in pocket 504 measure and record the pressures and temperatures immediately outside housing 501 adjacent ports 506.

Referring still to FIGS. 6 and 7, housing 501 (i.e., each body sections 507, 508) is made of a relatively dense, rigid material(s) that can be deployed and remain in the downhole environment in the presence of the flow of production fluids for a period of time, and then dissolve or degrade to release sensors 130. Examples of suitable materials for housing 501 include, without limitation, magnesium alloys.

In general, one or more pods 500 can be deployed downhole and used in any downhole operation to measure, record, and store pressure and temperatures over a period of time. For examples, pods 500 can be used in drilling operations (e.g., disposed along a drillstring or in a bottomhole assembly), perforating operations (e.g., deployed on wireline with a perforating assembly or gun), production operations (e.g., disposed along casing or a production string), etc.

Figure 8A:
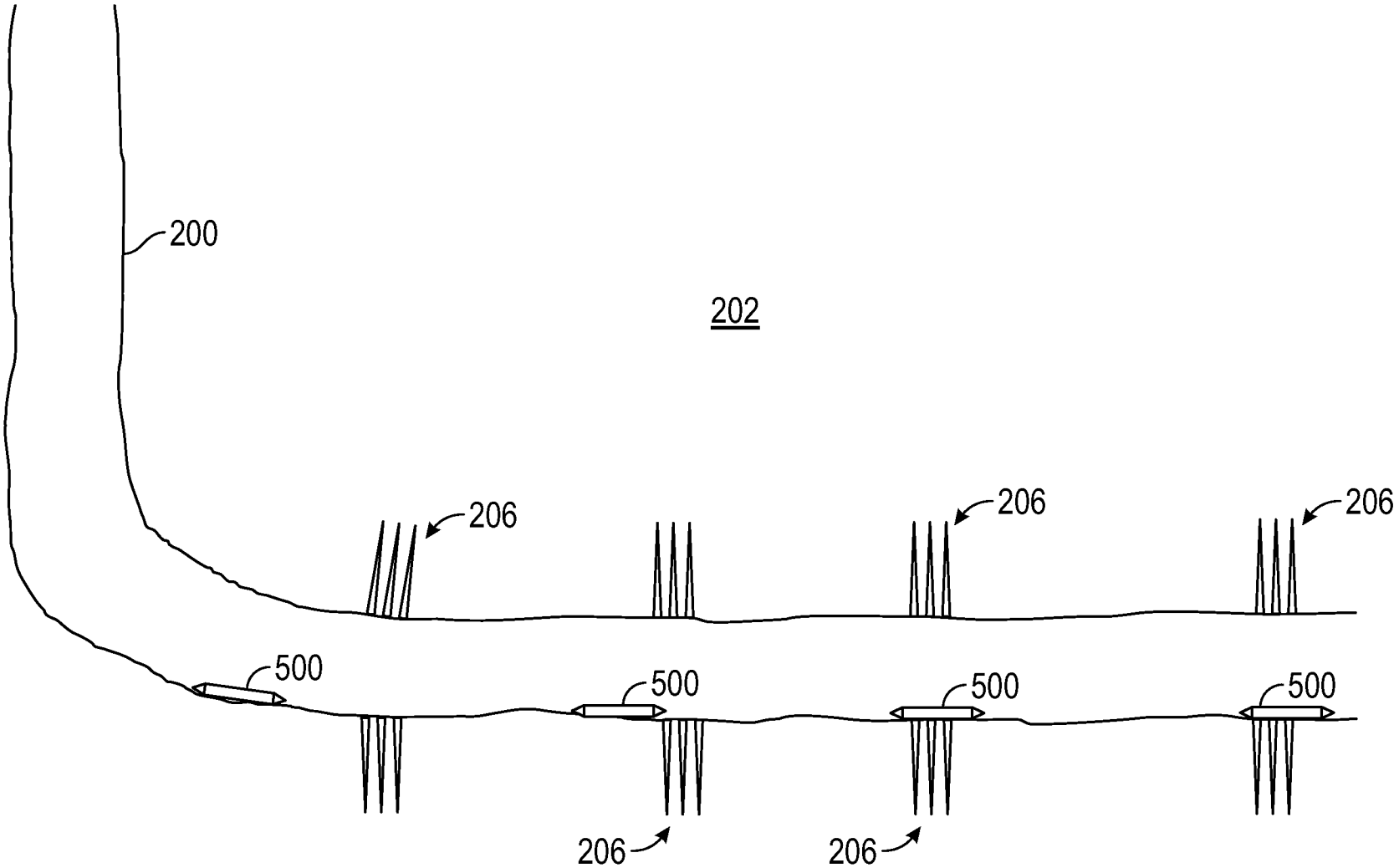
FIGS. 8A-8D are sequential schematic, partial cross-sectional views of a production operation in a subterranean wellbore employing a plurality of the sensor pod assemblies of FIG. 6.
Figure 8B:
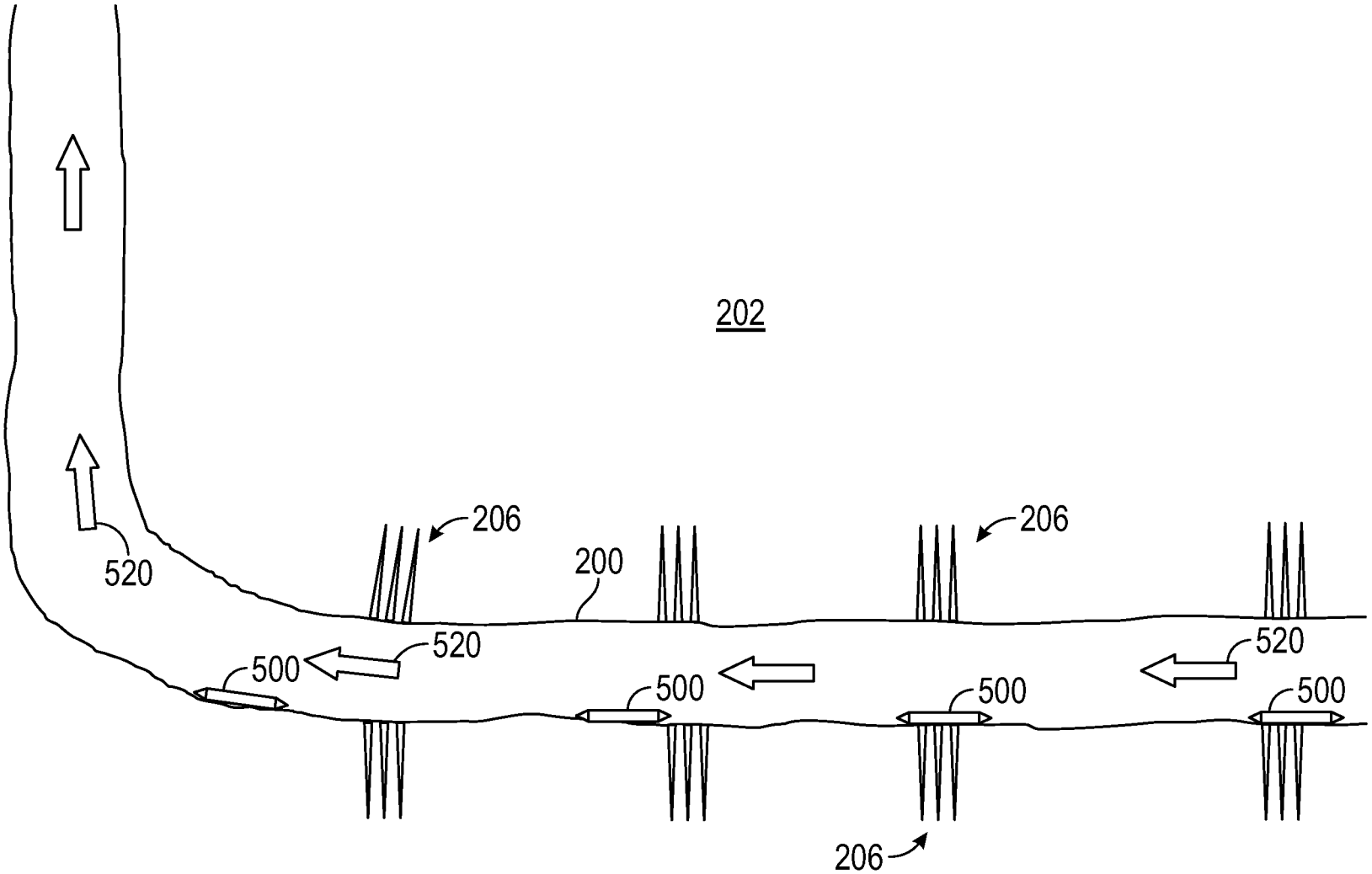

Referring now to FIGS. 8A-8D, in one exemplary embodiment, a plurality of pods 500 are deployed downhole to measure and record downhole pressures and temperatures during production operations. In FIGS. 8A and 8B, pods 500 are shown deployed in wellbore 200, and in FIGS. 8C and 8D, sensors 130 are shown being retrieved to the surface.

Referring first to FIG. 8A, with wellbore 200 shut-in at the surface, pods 500 are deployed and positioned along a horizontal section of wellbore 200. In particular, pods 500 are axially spaced along wellbore 200 and oriented with axes 505 substantially parallel to the longitudinal axis of wellbore 200. In addition, pods 500 sit along the bottom of wellbore 200. In general, pods 500 can be deployed in wellbore 200 by any suitable means known in the art. For instance, coiled tubing can be used to pump each pod 500, one at the time, to the desired depth. Another method for releasing the pods 500 could be the use of small electrically triggered charges that release each pod 500 from a wireline conveyed carrier.

Moving now to FIG. 8B, production begins after pods 500 are distributed along the bottom of wellbore 200 by opening wellbore 200 at the surface. The production fluids, represented by arrows 520, flow through wellbore 200 to the surface or flow through wellbore 200 into a production string disposed therein. As previously described, housings 501 have a density and geometry sufficient to remain in place along the bottom of wellbore 200 despite the flow of production fluids 520. Pods 500 are spaced along wellbore 200 to measure, record, and store pressures and temperatures of fluids in wellbore 200 via sensors 130 in pockets 504.

Figure 8C:
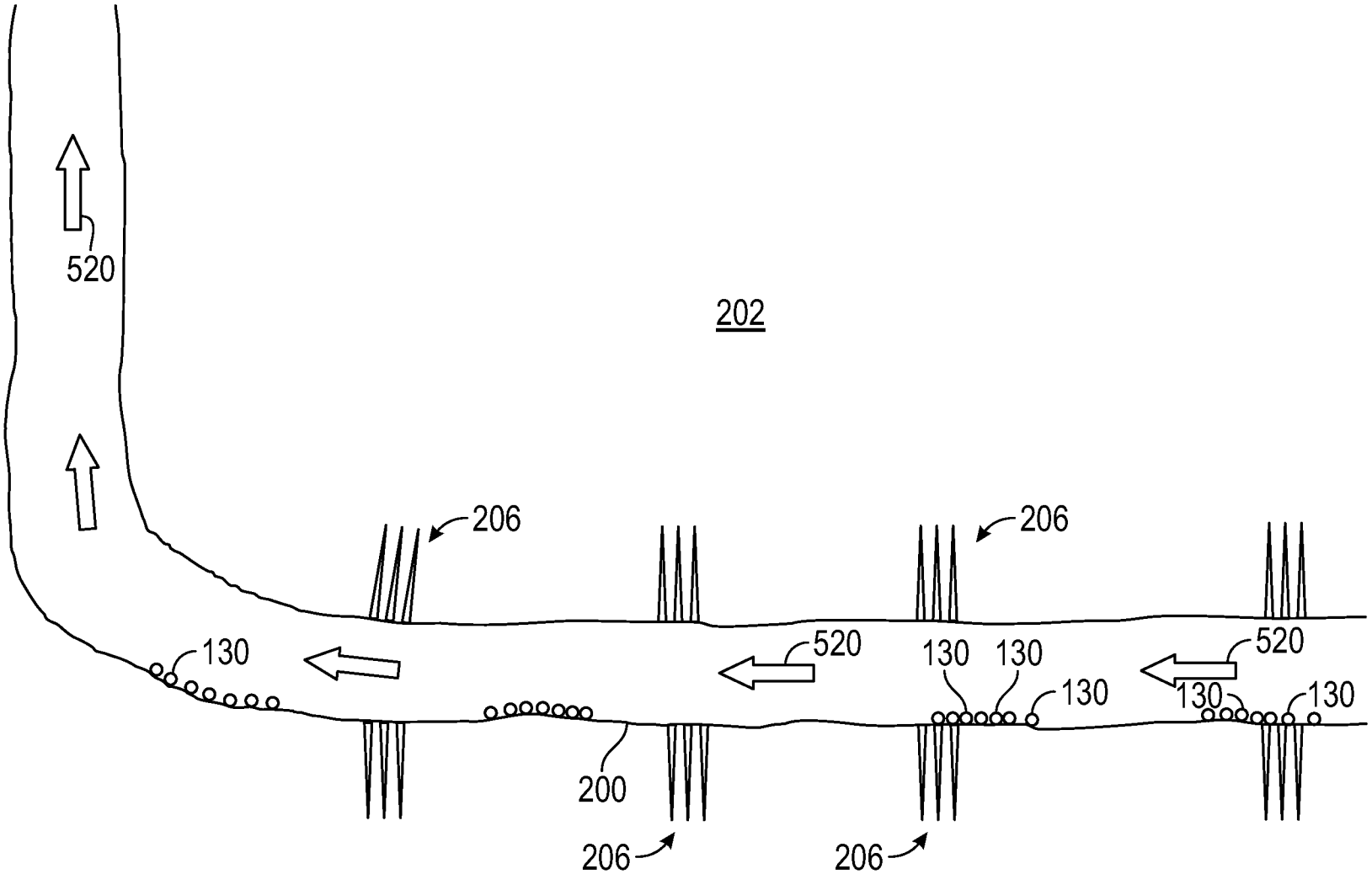
Figure 8D:
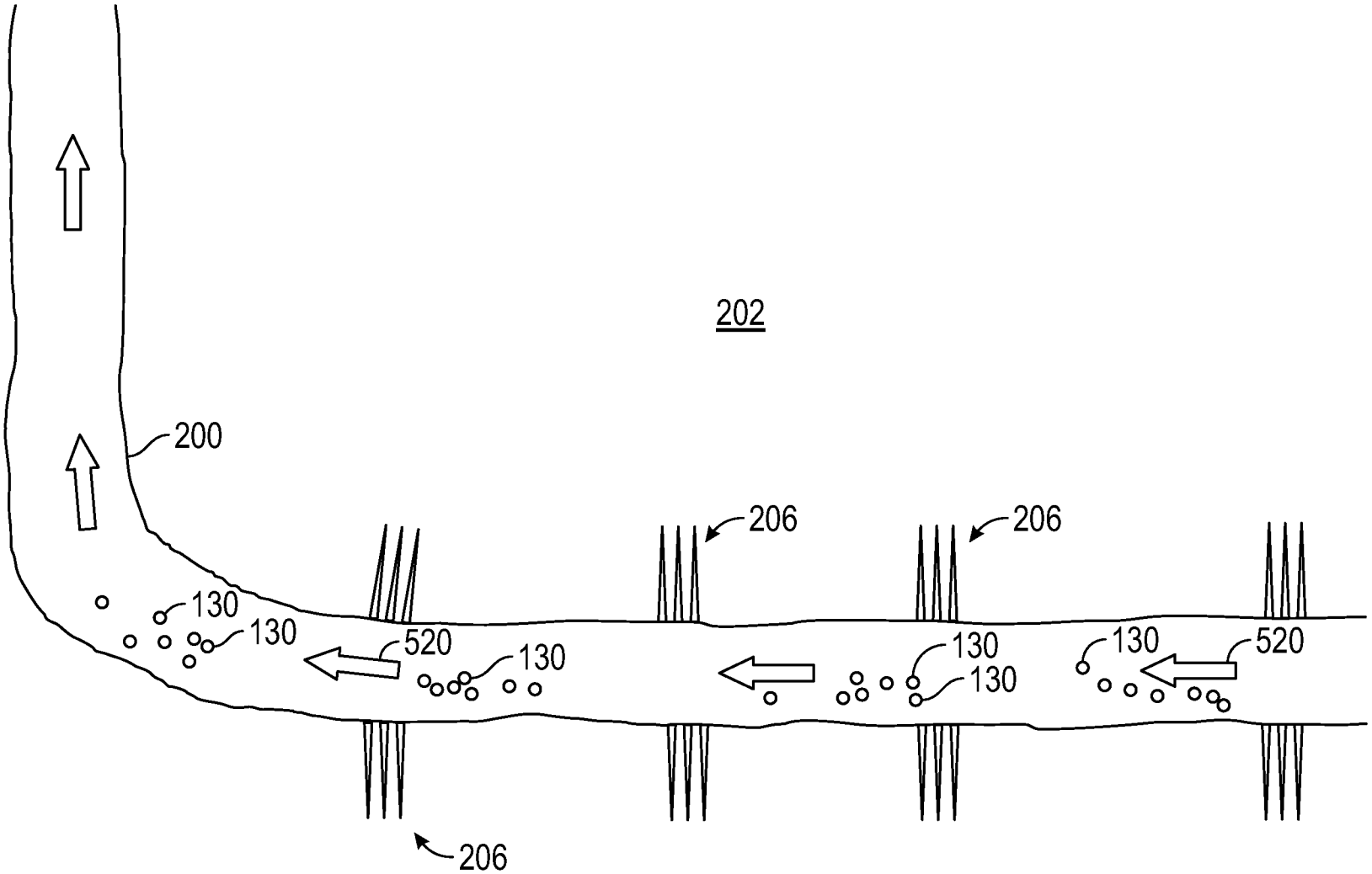
Figure 9:
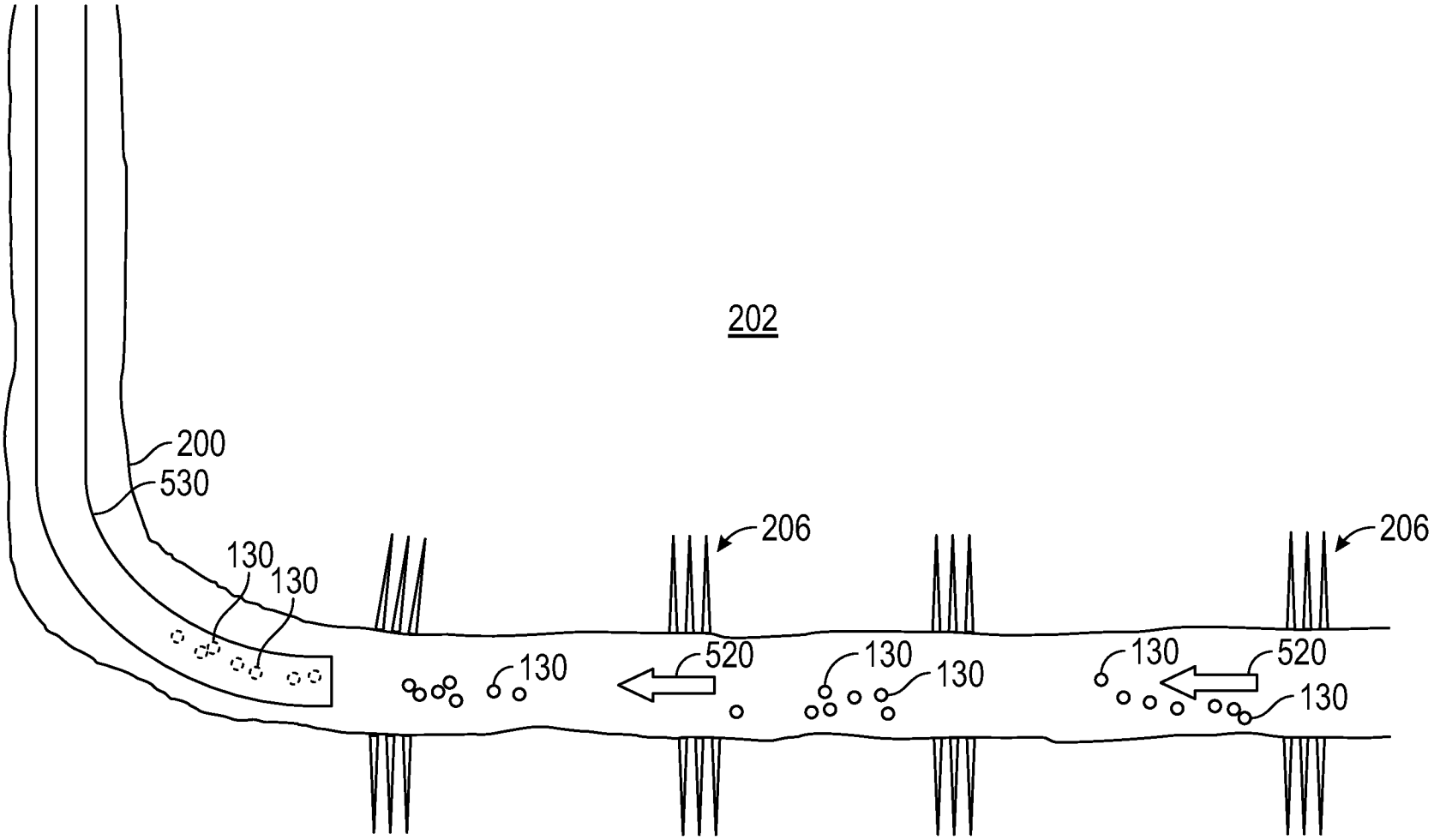
FIG. 9 is a schematic, partial cross-sectional views of a production operation in a subterranean wellbore illustrating an alternative embodiment for retrieving the pressure and temperature tracers released by the sensor pods of FIGS. 8A-8C.

Referring now to FIG. 8C, housings 501 are made of a material designed to dissolve or degrade over time. Thus, after a period of time, housings 501 dissolve, thereby releasing sensors 130 into the stream of production fluids 520. Once released, sensors 130 are picked up and carried to the surface with the production fluids 520 as shown in FIG. 8D, or alternatively are carried to the surface with production fluids 520 via production tubing 530 as shown in FIG. 9.

At the surface, the pressure and temperature measurements recorded and stored in sensors 130 during the production operation are downloaded and analyzed. Due to the distribution of pods 500 along wellbore 200 and the ability of sensors 130 to measure pressures and temperatures in wellbore 200, the data from sensors 130 can be used to determine the pressure and temperature profile along wellbore 200 during production. As previously described, the pressure and temperature profiles along a wellbore can provide valuable insight as to the production of the wellbore. For example, such information can aid in the identification and location of loss circulation zones and aid in the identification of stages that are producing and stages that are not producing (or are insufficiently producing). Further, in artificial lift production operations, comparison of the pressure profiles in the annulus and the inside of the production string can be used to determine the efficiency of the lift mechanism, and subsequently, optimize the lift mechanism employed.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A tool for measuring and recording downhole conditions during a production operation, the tool comprising:

a tubular sub having a central axis, a first end, a second end opposite the first end, a radially outer surface extending axially from the first end to the second end, a radially inner surface extending axially from the first end to the second end, a first pocket extending radially from the radially outer surface, and a second pocket extending radially from the radially outer surface, wherein the radially inner surface defines a throughbore extending axially from the first end to the second end;

a first sensor disposed in the first pocket;

a second sensor disposed in the second pocket;

a first cap releasably coupled to the sub and closing the first pocket, wherein the first cap includes a first port extending therethrough, wherein the first port is in fluid communication with the first pocket and the environment outside the sub;

a second cap releasably coupled to the sub and closing the second pocket, wherein the second cap is configured to prevent fluid communication between the second pocket and the environment outside the sub;

wherein the sub includes a second port extending from the throughbore to the second pocket.

2. The tool of claim 1, wherein the first sensor is configured to measure and record a plurality of pressures in the environment outside the sub, and wherein the second sensor is configured to measure and record a plurality of pressures within the throughbore.

3. The tool of claim 2, further comprising:

a third pocket extending radially from the radially outer surface of the sub;

a third sensor disposed in the third pocket;

a third cap releasably coupled to the sub and closing the third pocket, wherein the third cap includes a third port extending therethrough, wherein the third port is in fluid communication with the third pocket and the environment outside the sub;

wherein the third sensor is configured to measure and record a plurality of temperatures in the environment outside the sub.

4. The tool of claim 1, wherein the first end is a pin end and the second end is a box end.

5. The tool of claim 1, wherein the first sensor is configured to measure and record a plurality of temperatures in the environment outside the sub.

6. The tool of claim 1, wherein the second sensor is configured to measure and record a plurality of pressures in the throughbore.

7. The tool of claim 1, wherein the first cap is threadably coupled to the sub, and wherein the second cap is threadbly coupled to the sub.

8. The tool of claim 7, wherein the first sensor is configured to move within the first pocket, and the second sensor is configured to move within the second pocket.

9. The tool of claim 8, wherein the first sensor is configured to move rotationally and translationally within the first pocket.

10. The tool of claim 9, wherein the second sensor is configured to move rotationally and translationally within the second pocket.

11. The tool of claim 1, wherein the first cap includes a first outer semi-cylindrical surface and a first inner semi-spherical surface that is radially spaced from the first outer semi-cylindrical surface with respect to the central axis.

12. The tool of claim 11, wherein the second cap includes a second outer semi-cylindrical surface and a second inner semi-spherical surface that is radially spaced from the second outer semi-cylindrical surface with respect to the central axis.

13. A tool for measuring downhole conditions during a production operation, the tool comprising:

a tubular sub having a central axis, an axially extending throughbore, and a radially outer surface, and comprising:

a first pocket extending into the tubular sub from the radially outer surface to a first terminal end, wherein the terminal end is spaced radially between the radially outer surface and the throughbore with respect to the central axis;

a first cap coupled to the sub to close the first pocket, wherein the first pocket is in fluid communication with an outer environment that surrounds the radially outer surface through the first cap;

a second pocket extending into the tubular sub from the radially outer surface to a second terminal end, wherein the second terminal end is spaced radially between the radially outer surface and the throughbore with respect to the central axis;

a port extending from the second terminal end to the throughbore;

a second cap coupled to the sub to close the second pocket, wherein the second cap is configured to prevent fluid communication between the second pocket in the outer environment;

a first sensor positioned within the first pocket such that the first sensor is configured to move within the first pocket; and a second sensor positioned within the second pocket such that the second sensor is configured to move within the second pocket.

14. The tool of claim 13, wherein the first sensor is configured to move rotationally and translationally within the first pocket.

15. The tool of claim 14, wherein the second sensor is configured to move rotationally and translationally within the second pocket.

16. The tool of claim 13, wherein at least one of the first sensor and the second sensor is configured to measure pressure.

17. The tool of claim 16, wherein at least one of the first sensor and the second sensor is configured to measure temperature.

18. The tool of claim 13, wherein the sub comprises a threaded pin end and a threaded box end opposite the threaded pin end along the central axis.

19. The tool of claim 18, wherein the first cap is threadably coupled to the sub, and wherein the second cap is threadably coupled to the sub.

20. The tool of claim 19, wherein the first cap includes a first outer semi-cylindrical surface and a first inner semi-spherical surface that is radially spaced from the first outer semi-cylindrical surface with respect to the central axis, and wherein the second cap includes a second outer semi-cylindrical surface and a second inner semi-spherical surface that is radially spaced from the second outer semi-cylindrical surface with respect to the central axis.

* * * * *